US009394901B2

(12) United States Patent
Hill

(10) Patent No.: US 9,394,901 B2
(45) Date of Patent: Jul. 19, 2016

(54) PUMPING SYSTEMS

(76) Inventor: Kevin Thomas Hill, Phoenix, AZ (US)

( * ) Notice: Subject to any disclaimer, the term of this patent is extended or adjusted under 35 U.S.C. 154(b) by 1302 days.

(21) Appl. No.: 13/159,742

(22) Filed: Jun. 14, 2011

(65) Prior Publication Data

US 2011/0311386 A1 Dec. 22, 2011

Related U.S. Application Data

(60) Provisional application No. 61/355,515, filed on Jun. 16, 2010, provisional application No. 61/361,887, filed on Jul. 6, 2010, provisional application No. 61/429,412, filed on Jan. 3, 2011.

(51) Int. Cl.

| | |
|---|---|
| ***F04C 2/00*** | (2006.01) |
| ***F04C 2/14*** | (2006.01) |
| ***F04C 13/00*** | (2006.01) |
| ***F04C 15/00*** | (2006.01) |

(52) U.S. Cl.

CPC ..... *F04C 2/14* (2013.01); *F04C 13/002* (2013.01); *F04C 15/0049* (2013.01); *F04C 2220/24* (2013.01); *F04C 2240/70* (2013.01)

(58) Field of Classification Search

CPC ..... F04C 2/107; F04C 2/14; F04C 2/16; F04C 13/002; F04C 14/04; F04C 14/24; F04C 15/0049; F04C 2240/70; F04C 2220/24; F04B 2240/70

USPC ..... 417/238, 239, 310; 418/206.1, 206.5

See application file for complete search history.

(56) References Cited

U.S. PATENT DOCUMENTS

| | | | | | |
|---|---|---|---|---|---|
| 2,382,042 | A | * | 8/1945 | Etnyre | 418/200 |
| 2,391,072 | A | * | 12/1945 | Pugh | 418/77 |
| 2,672,100 | A | * | 3/1954 | Harvey | 418/206.6 |
| 2,746,394 | A | * | 5/1956 | Dolza et al. | 418/73 |
| 2,871,794 | A | * | 2/1959 | Mosbacher | 418/135 |
| 3,495,610 | A | * | 2/1970 | Van Aken, Jr. | 137/99 |
| 3,811,471 | A | | 5/1974 | Murase | |
| 3,865,523 | A | * | 2/1975 | Baehr | 418/201.1 |
| 4,548,562 | A | * | 10/1985 | Hughson | 418/189 |
| 4,645,439 | A | * | 2/1987 | Way | 418/104 |
| 4,898,302 | A | * | 2/1990 | Byerly et al. | 222/49 |
| 5,072,752 | A | | 12/1991 | Kolchinsky | |
| 5,174,544 | A | | 12/1992 | Emanie | |
| 5,397,219 | A | * | 3/1995 | Cretors | 417/299 |
| 5,722,815 | A | | 3/1998 | Cozens | |
| 6,131,770 | A | * | 10/2000 | Allen | 222/55 |
| 6,152,719 | A | * | 11/2000 | Nelik et al. | 418/201.1 |
| 6,174,151 | B1 | | 1/2001 | Yarr | |

(Continued)

FOREIGN PATENT DOCUMENTS

| | | | |
|---|---|---|---|
| EP | 0559582 | A1 | 9/1993 |
| JP | 06-047685 | U | 6/1994 |
| JP | 2000-087872 | A | 3/2000 |

*Primary Examiner* — Charles Freay

(74) *Attorney, Agent, or Firm* — Michael W. Goltry; Robert A. Parsons; Parsons & Goltry

(57) ABSTRACT

A modular symmetrical asphalt pumping system providing a series of field-configurable gear pumps and meters usable to safely and efficiently pump viscous molten fluids, such as, asphalt and similar bituminous materials. The system utilizes highly symmetrical physical geometries and modular components to allow for the development of multiple pump configurations using a reduced quantity of parts. Preferred arrangements of the system reduce pump pulsing and cavitation.

31 Claims, 18 Drawing Sheets

(56) References Cited

U.S. PATENT DOCUMENTS

| | | | | |
|---|---|---|---|---|
| 6,309,199 | B1 * | 10/2001 | Devine | 418/104 |
| 6,533,556 | B1 | 3/2003 | Cozens et al. | |
| 6,586,172 | B1 * | 7/2003 | Gunn et al. | 435/2 |
| 6,758,656 | B2 | 7/2004 | Maier et al. | |
| 6,935,851 | B2 * | 8/2005 | Peters et al. | 418/15 |
| 6,964,163 | B2 | 11/2005 | Landhuis | |
| 7,011,069 | B2 | 3/2006 | Ono et al. | |
| 7,179,070 | B2 | 2/2007 | O'Brien, II | |
| 7,588,431 | B2 | 9/2009 | O'Brien, II | |
| 7,637,725 | B2 | 12/2009 | Berger | |
| 8,430,657 | B2 * | 4/2013 | Simonelli et al. | 418/104 |
| 2005/0158183 | A1 | 7/2005 | Marioni | |
| 2009/0120507 | A1 | 5/2009 | Simonelli et al. | |
| 2009/0266422 | A1 | 10/2009 | Flavelle | |
| 2009/0297384 | A1 | 12/2009 | Seabolt | |
| 2010/0150764 | A1 * | 6/2010 | Simonelli et al. | 418/191 |
| 2014/0271314 | A1 * | 9/2014 | Morselli | 418/206.5 |
| 2014/0348686 | A1 * | 11/2014 | Paval et al. | 418/201.1 |

* cited by examiner

A
A

PUMPING SYSTEMS

CROSS-REFERENCE TO RELATED APPLICATIONS

The present application is related to and claims priority from prior provisional application Ser. No. 61/355,515, filed Jun. 16, 2010, entitled "MODULAR SYMMETRICAL ASPHALT PUMPING SYSTEMS"; and, this application is related to and claims priority from prior provisional application Ser. No. 61/361,887, filed Jul. 6, 2010, entitled "PUMPING SYSTEMS"; and, this application is related to and claims priority from prior provisional application Ser. No. 61/429,412, filed Jan. 3, 2011, entitled "PUMPING SYSTEMS", the contents of all of which are incorporated herein by this reference and are not admitted to be prior art with respect to the present invention by the mention in this cross-reference section.

BACKGROUND

This invention relates to reduced-pulsation pumping systems. More particularly, this invention relates to pulsation-reducing pumping systems which provide superior pumping capability through the reduction of fluid pulsations and cavitation tendencies. In addition, this invention relates to gear pumps having increased operational safety and superior field configurability.

Fluid pulsation is a hallmark of conventional positive-displace gear pumps. Flow pulsation during the operation of such pumps is often associated with damage to piping, meters, valves, and instrumentation. In addition, flow pulsation in essential production processes often contributes to poor and/or inconsistent product quality, thus producing off-spec waste or inferior final results. Particularly problematic is the reduced accuracy of flow metering and measurement devices (especially in pulse-sensitive coriolis flow meter apparatus) that result from fluid pulsation. A means for directly reducing flow pulsation and similar "noise" within the output of positive displacement pumps would be of great benefit to many fields.

Gear pump cavitation is associated with reduced pumping performance and erosion of internal pumping surfaces. Cavitation generally results from the sudden formation and collapse of low-pressure bubbles in the fluid being pumped. Increasing gear pump performance by reducing the tendency of a given pump to experience cavitation at elevated pump speeds would be of great benefit in many fields, including asphalt pumping.

Asphalt is a cementitious material widely used in numerous industrial applications including paving and roofing. Many asphalt-installation procedures require the asphaltic materials to be heated into a workable molten state prior to use. It is common for such hot asphalt materials to be maintained at temperatures ranging between about 100 and 200 degrees Celsius. Specialized pumping apparatus is frequently used to transfer and meter such hot asphaltic materials.

Numerous safety hazards arise from the handling of asphalt in an elevated temperature. Asphalt has a large thermal capacity and therefore poses a high potential for serious injury should an uncontrolled release of the materials occur. An ideal pumping apparatus would prevent failures by controlling any overpressures occurring within an asphalt pumping system, for the full duration of the material transfer, including forward, reverse, and high-volume pumping operations.

Conventional asphalt-pump designs provide limited or marginal pressure safety during operation, and are not readily modifiable using straightforward engineering. Furthermore, conventional asphalt-pump designs have remained substantially unchanged over time and currently offer little in terms of adaptability/field configurability. Improvements in asphalt pumping systems to provide safe and efficiently adaptable designs would also be of great benefit to many.

OBJECTS AND FEATURES OF THE INVENTION

A primary object and feature of the present invention is to provide a system overcoming the above-mentioned problems.

It is a further object and feature of the present invention to provide such a system that provides a direct means for reducing flow pulsation within positive displacement pumps. It is another object and feature of the present invention to provide increased gear pump performance by reducing the tendency of a given pump to experience cavitation at elevated pump speeds. It is another object and feature of the present invention to provide such a system having improved protection from unsafe overpressures, which can arise when portions of the asphaltic materials within the pumping system fail to reach or maintain the necessary molten-fluid state. It is another object and feature of the present invention to provide such a system using a set of interchangeable modular components to provide a highly adaptable asphalt pumping device. It is a further object and feature of the present invention to provide such a system that utilizes a symmetrical physical geometry to increase modularity within the mateable components of the system. A further primary object and feature of the present invention is to provide such a system that is efficient, inexpensive, and useful. Other objects and features of this invention will become apparent with reference to the following descriptions.

SUMMARY OF THE INVENTION

In accordance with a preferred embodiment hereof, this invention provides a system relating to pumping viscous molten fluids comprising: at least one modular-component pump structured and arranged to pump the viscous molten fluids; wherein such at least one modular-component pump comprises at least one central pump housing having at least one first open end, at least one second open end, and at least one internal chamber extending therebetween, at least one inlet to inlet the viscous molten fluids to within such at least one internal chamber and at least one outlet to outlet the viscous molten fluids therefrom, operating within such at least one internal chamber, at least one shaft-driven fluid displacer to displace the viscous molten fluid from such at least one inlet to such at least one outlet, a first single-geometry end unit structured and arranged to interchangeably engage a selected one of either of such at least one first open end or such at least one second open end, a second single-geometry end unit, having a geometric configuration common with such first single-geometry end unit, such second single-geometry end unit structured and arranged to interchangeably engage a remaining one of either of such at least one first open end or such at least one second open end, and at least one set of interchangeable end-unit modifiers each one structured and arranged to interchangeably modify the function of such first single-geometry end unit and such second single-geometry end unit; wherein such at least one shaft-driven fluid displacer comprises at least one driveshaft structured and arranged operably couple such at least one shaft-driven fluid displacer with at least one source of rotational power external of such central pump housing; wherein such at least one set of interchangeable end-unit modifiers comprises at least one shaft-type modifier structured and arrange to modify either of such first single-geometry end unit and such second single-geometry end unit to comprise at least one drive-shaft passage enabling rotatable passage of such at least one driveshaft therethrough, and at least one cover-type modifier structured and arrange to cover at least one external opening, of either of such first single-geometry end unit and such second single-geometry end unit, in fluid communication with at least one internal chamber.

Moreover, it provides such a system wherein: such at least one shaft-driven fluid displacer is structured and arranged to generate, within such at least one internal chamber, at least one suction-pressure region in fluid communication with such at least one inlet and at least one discharge-pressure region in fluid communication with such at least one outlet port; each one of such first single-geometry end unit and such second single-geometry end unit further comprise at least one first fluid return passage structured and arranged return the viscous molten fluids from such at least one discharge-pressure region to such at least one suction-pressure region; such at least one first fluid return passage comprises at least one first return inlet, at least one first return outlet, and at least one control valve structured and arranged to control passage of the viscous molten fluid between such at least one first return inlet and such at least one first return outlet; such at least one control valve comprises at least one normally closed position blocking flow of the viscous molten fluids through such at least one first fluid return passage and at least one open position enabling one-way flow of the viscous molten fluids between such at least one first return inlet and such at least one first return outlet; such at least one control valve is configured to transition from such at least one normally closed position to such at least one open position in response to at least one elevated fluid pressure in such at least one discharge-pressure region above at least one selected pressure threshold; and when such at least one control valve is in such at least one open position, return circulation of the viscous molten fluids through such at least one first fluid return passage is enabled between such at least one discharge-pressure region and such at least one suction-pressure region.

Additionally, it provides such a system wherein such at least one control valve comprises at least one pressure-threshold selector structured and arranged to enable user selection of the at least one selected pressure threshold. Also, it provides such a system wherein such at least one modular-component pump further comprises: at least one positive-displacement external gear pump; wherein such at least one shaft-driven fluid displacer comprises a first pumping gear disposed rotatably within such at least one internal chamber, and meshing with such first pumping gear, a second pumping gear disposed rotatably within such at least one internal chamber; wherein such first pumping gear comprises such at least one input shaft, and a first rotational axis oriented coaxially with such at least one drive shaft; wherein such second pumping gear comprises a second rotational axis spaced apart from and generally parallel to such first rotational axis; wherein each such single-geometry end unit comprises at least two gear-journal bores structured and arranged to rotatably journal therein such first pumping gear and such second pumping gear; wherein each one of such at least two gear-journal bores is structured and arranged to interchangeably journal therein either one of such first pumping gear and such second pumping gear; and wherein each one of such at least two gear-journal bores extends through single-geometry end unit to enable passage of such at least one driveshaft therethrough.

In addition, it provides such a system wherein: when disposed within such at least one internal chamber, such first pumping gear and such second pumping gear are structured and arranged to divide such at least one internal chamber into at least one first chamber portion and at least one second chamber portion; such at least one first chamber portion is configured to comprise such at least one suction-pressure region when such at least one driveshaft is driven in a forward rotation; such at least one second chamber portion is configured to comprise such at least one discharge-pressure region when such at least one driveshaft is driven in the forward rotation; such at least one first chamber portion is configured to comprise such at least one discharge-pressure region when such at least one driveshaft is driven in a reversed rotation; such at least one second chamber portion is configured to comprise such at least one suction-pressure region when such at least one driveshaft is driven in the reversed rotation; and such at least one first fluid return passage is in fluid communication with both such at least one first chamber portion and such at least one second chamber portion.

Furthermore, it provides such a system wherein such at least one single-geometry end unit comprises: a first plane of symmetry dividing such single-geometry end unit into a first half portion and a second half portion; wherein such first half portion and such second half portion comprise symmetrically opposite functional geometries; wherein, such first plane of symmetry is located equidistant from both such first rotational axis and such second rotational axis; and wherein, when such at least one single-geometry end unit is mated to such central pump housing, such first plane of symmetry is oriented perpendicular to an axis-containing plane containing both such first rotational axis and such second rotational axis. Further, it provides such a system wherein such first half portion and such second half portion each comprise a gear-journal bore of such at least two gear-journal bores. Further, it provides such a system wherein each such gear-journal bore comprises at least one plain bearing.

Even further, it provides such a system wherein: such at least one first fluid return passage is disposed between each such gear-journal bore of such first half portion and such second half portion and in at least one position intersecting such first plane of symmetry; and such at least one single-geometry end unit structured and arranged to be symmetrically mountable to such at least one central housing to selectably locate such at least one first return inlet and such at least one first return outlet in fluid communication with either of such at least one first chamber portion and such at least one second chamber portion.

Moreover, it provides such a system wherein such at least one central housing further comprises: at least one mount structured and arranged to assist mounting of such at least one modular-component pump to at least one mountable support external of such at least one modular-component pump; wherein such at least one mount comprises at least one mounting contact surface, comprising at least one contact-surface plane, structured and arrange to contact the at least one mountable support; wherein such at least one central housing is further structured and arranged to orient such axis-containing plane, containing both such first rotational axis and such second rotational axis, in at least one non-parallel orientation relative to such at least one contact-surface plane; and wherein such at least one non-parallel orientation geometrically positions one of either of such first rotational axis or such second rotational axis further from such at least one mounting-surface plane than the other one of such first rotational axis or such second rotational axis when such first pumping gear and such second pumping gear are journaled rotatably within such first single-geometry end unit and such at least one second single-geometry end unit.

Additionally, it provides such a system wherein such at least one central housing is further structured and arranged to orient such axis-containing plane, containing both such first rotational axis and such second rotational axis, at about a 45-degree angle relative to such at least one contact-surface plane. Also, it provides such a system wherein such at least one shaft-type modifier comprises: detachably mountable to either of such first half portion and such second half portion, at least one apertured cap plate having at least one shaft-passing aperture structured and arranged to enable outward passage of such at least one driveshaft therethrough; wherein such at least one shaft-passing aperture of such at least one apertured cap plate is structured and arranged to coaxially align with a respective one of such at least two gear-journal bores when such at least one apertured cap plate is detachably mounted to either of such first half portion and such second half portion.

In addition, it provides such a system wherein such at least one cover-type modifier comprises: detachably mountable to either of such first half portion and such second half portion, at least one non-apertured cap plate structured and arranged to cover a respective one of such at least two gear-journal bores when such at least one apertured cap plate is detachably mounted to either of such first half portion and such second half portion. And, it provides such a system wherein such at least one single-geometry end unit comprises at least one first outer fluid jacket structured and arranged to assist circulation of at least one thermal-transfer fluid usable to control the temperature of the viscous molten fluids within such at least one single-geometry base unit.

Further, it provides such a system wherein such at least one central pump housing comprises at least one second outer fluid jacket structured and arranged to assist circulation of the at least one thermal-transfer fluid usable to control the temperature of the viscous molten fluids within such at least one central pump housing. Even further, it provides such a system wherein: such first single-geometry end unit is operably-mounted to such at least one central pump housing in at least one orientation locating such at least one first return inlet, of such at least one first configurable end cover, in fluid communication with such at least one second chamber portion; such second single-geometry end unit is operably-mounted to such at least one central pump housing in at least one orientation locating such at least one first return inlet, of such at least one second single-geometry end unit, in fluid communication with such at least one first chamber portion; return circulation of the viscous molten fluids is enabled between such at least one second chamber portion and such at least one first chamber portion through such at least one first fluid return passage of such at least one first single-geometry end unit when at least one fluid pressure above the at least one selected pressure threshold is developed within such at least one discharge-pressure region of such at least one second chamber portion by a forward rotation of such at least one input shaft; and return circulation of the viscous molten fluids is enabled between such at least one first chamber portion and such at least one second chamber portion through such at least one first fluid return passage of such at least one second single-geometry end unit when at least one fluid pressure above the at least one selected pressure threshold is developed within such at least one discharge-pressure region of such at least one first chamber portion by a reverse rotation of such at least one input shaft. Even further, it provides such a system wherein such at least one pressure-threshold selector of such at least one control valve of such first single-geometry end unit is adjustable independently of such at least one pressure-threshold selector of such at least one control valve of such at least one second single-geometry end unit.

Even further, it provides such a system wherein: such first single-geometry end unit is operably-mounted in at least one orientation locating such at least one first return inlet, of such at least one first configurable end cover, in fluid communication with such at least one second chamber portion; such second single-geometry end unit is operably-mounted in at least one orientation locating such at least one first return inlet, of such at least one second single-geometry end unit, in fluid communication with such at least one second chamber portion; and high-volume return circulation of the viscous molten fluids is enabled between such at least one second chamber portion and such at least one first chamber portion by a return flow through both such at least one fluid return passages of such first single-geometry end unit and such at least one second single-geometry end unit when at least one fluid pressure above the at least one selected pressure threshold is developed within such at least one discharge-pressure region of such at least one second chamber portion.

In accordance with another preferred embodiment hereof, this invention provides a pumping system relating to pumping viscous molten fluids comprising: a modular-component pump structured and arranged to pump the viscous molten fluids; wherein such modular-component pump comprises a pump housing having a right-hand open end, a left-hand open end, and an internal chamber extending therebetween, an inlet to inlet the viscous molten fluids to within such internal chamber and at least one outlet to outlet the viscous molten fluids therefrom, operating within such internal chamber, a shaft-driven fluid displacer to displace the viscous molten fluid from such inlet to such outlet, and interchangably mountable to either of such right-hand open end and such left-hand open end, a modifiable single-geometry end unit structured and arranged to modifiably cover such internal chamber; wherein such shaft-driven fluid displacer comprises an driveshaft structured and arranged operably couple such shaft-driven fluid displacer with at least one source of rotational power external of such pump housing; wherein such at least one modular-component pump is configurable in at least four configurations using two such modifiable single-geometry end units; wherein such modifiable single-geometry end units are selectably mountable to such pump housing in such at least four configurations; wherein at least two left-hand driveshaft configurations, enabling left-hand outward passage of such driveshaft from such pump housing, are field configurable; and wherein at least two right-hand driveshaft configurations, enabling right-hand outward passage of such driveshaft from such pump housing, are field configurable.

Even further, it provides such a pumping system wherein: each such modifiable single-geometry end unit comprises at least one pressure-relief valve structured and arranged to return circulation of the viscous molten fluids between at least one discharge-pressure region and at least one suction-pressure region of such internal chamber in response to at least one elevated fluid pressure in such at least one discharge-pressure region above at least one selected pressure threshold; and such at least one modular-component pump is field configurable in at least three pressure-relieving configurations using two such modifiable single-geometry end units, each one comprising such at least one pressure-relief valve.

Furthermore, it provides such a pumping system wherein at least one of such at least three pressure-relieving configurations comprises a cotemporaneous pressure-reliving operation by such at least one pressure-relief valves. Even further, it provides such a pumping system wherein: at least one of such at least three pressure-relieving configurations comprises forward pressure-relief by a first of such at least one pressure-relief valves during forward pumping operation; and reverse pressure-relief by a second of such at least one pressure-relief valves during reverse pumping operation.

In accordance with another preferred embodiment hereof, this invention provides a pumping system relating to pumping viscous molten fluids comprising: a modular-component pump structured and arranged to pump the viscous molten fluids; wherein such modular-component pump comprises at least one pump housing having at least one first open end, at least one second open end, and at least one internal chamber extending therebetween, at least one inlet to inlet the viscous molten fluids to within such at least one internal chamber and at least one outlet to outlet the viscous molten fluids therefrom, operating within such at least one internal chamber, at least one shaft-driven fluid displacer to displace the viscous molten fluid from such at least one inlet to such at least one outlet, and a modular housing plate mountable to either of such at least one first open end and such at least one second open end; wherein such at least one shaft-driven fluid displacer comprises at least one driveshaft structured and arranged operably couple such at least one shaft-driven fluid displacer with at least one source of rotational power external of such central pump housing; and wherein each such modular housing plate is configurable as either a pump end plate, to cap a selected one of either such at least one first open end or such at least one second open end, or a pump shaft plate structured and arranged to accommodate passage of such at least one driveshaft through such modular housing plate from a selected one of either of such at least one first open end or such at least one second open end.

In accordance with a preferred embodiment hereof, this invention provides a pump system, relating to the reduction of pressure pulsations during pumping of fluids, comprising: at least one gear pump comprising at least one internal pumping chamber; disposed within such at least one internal pumping chamber, a set of intermeshing helical gears; wherein each helical gear of such set of intermeshing helical gears comprises a set of gear teeth defining an outer addendum circle and an inner root circle; and an opposing pair of terminating gear faces defining a gear-face width; wherein each terminating gear face of such opposing pair of terminating gear faces is oriented transversely to a respective rotation axis of such set of intermeshing helical gears; wherein such set of gear teeth comprise a helix angle, relative to such respective rotation axis, providing exactly a one-half tooth pitch rotation from one terminating gear face to the opposing terminating gear face; and wherein fluid pressure pulses are reduced essentially by pulse-pressure cancellation.

Moreover, it provides such a system wherein: when disposed within such at least one internal chamber, such a set of intermeshing helical gears are structured and arranged to divide such at least one internal chamber into at least one discharge-pressure region and at least one suction-pressure region; such at least one gear pump comprises at least one fluid return passage structured and arranged return the viscous molten fluids from such at least one discharge-pressure region to such at least one suction-pressure region; wherein such at least one fluid return passage comprises in fluid communication with such at least one discharge-pressure region, at least one second return inlet, in fluid communication with such at least one suction-pressure region, at least one second return outlet, and in fluid communication with such at least one second return inlet and such at least one second return outlet, at least one fluid pathway extending therebetween; wherein such at least one fluid return passage comprises at least one flow modulator structured and arranged to modulate the flow volume of the viscous molten fluids through such at least one second fluid pathway; and wherein fluid pressure pulses are further reduced essentially by pulse-pressure cancellation.

Additionally, it provides such a system further comprising: at least one active controller structured and arranged to actively control the operation of such at least one flow modulator; wherein such at least one active controller comprises at least one coordinator structured and arranged to coordinate the operational timing of such at least one flow modulator with cyclic pressure fluctuations exhibited by such at least one gear pump during operation; wherein such at least one coordinator is configured to enable a maximum flow volume, through such at least one fluid pathway, coinciding with both maximum elevated positive pressure levels and maximum reduced positive pressure levels within such at least one discharge-pressure region; wherein such at least one coordinator is configured to enable a minimum flow volume, through such at least one second fluid pathway, coinciding with pressure transitions, within such at least one discharge-pressure region, between such maximum elevated positive pressure levels and such maximum reduced positive pressure levels; wherein such controlled modulation of the flow of the viscous molten fluids through such at least one fluid pathway assists in reducing peak amplitudes of such cyclic pressure fluctuations exhibited by such at least one gear pump during operation.

Also, it provides such a system further comprising at least one metering device structured and arranged to meter outputs of the viscous molten fluids. In addition, it provides such a system wherein such at least one metering device comprises at least one coriolis-type flow meter. And, it provides such a system wherein such at least one metering device comprises at least one outer fluid jacket structured and arranged to assist circulation of at least one thermal-transfer fluid usable to control the temperature of the viscous molten fluids within such at least one metering device.

In accordance with another preferred embodiment hereof, this invention provides a system, relating to metering in pumping viscous molten fluids, comprising: at least one gear pump structured and arranged to pump the viscous molten fluids; and operably coupled with such at least one gear pump, at least one metering device structured and arranged to meter outputs of the viscous molten fluids; wherein such at least one modular-component pump comprises at least one first set of outer fluid jackets structured and arranged to assist circulation of at least one thermal-transfer fluid usable to control the temperature of the viscous molten fluids within such at least one modular-component pump; wherein such at least one metering device comprises at least one second set of outer fluid jackets structured and arranged to assist circulation of the at least one thermal-transfer fluid usable to control the temperature of the viscous molten fluids within such at least one metering device; wherein such at least one second set of outer fluid jackets comprise at least one fluid coupler structured and arranged to fluid couple such at least one second set of outer fluid jackets and such at least one first set of outer fluid jackets; and wherein such at least one fluid coupler enables circulation of the at least one thermal-transfer fluid between such at least one third outer fluid jacket and such at least one second outer fluid jacket. Further, it provides such a system wherein such at least one metering device comprises at least one coriolis-type flow meter.

In accordance with another preferred embodiment hereof, this invention provides a pump system, relating to pump bearing lubrication, comprising: at least one gear pump structured and arranged to pump liquids wherein such at least one pump comprises at least one fluid displacer structured and arranged to displace viscous molten fluids from at least one inlet to such at least one outlet of such at least one gear pump, and at least one bearing surface structured and arranged to rotatably journal at least one shaft portion of such at least one fluid displacer; at least one lubrication pathway structured and arranged to assist lubrication of such at least one bearing surface using the viscous molten fluids; wherein such at least one pump is structured and arranged to move the viscous molten fluids through such at least one lubrication pathway by at least one differential pressure generated during operation of such at least one pump; and wherein such at least one pump is structured and arranged to provide one-way movement of the viscous molten fluids through such at least one lubrication pathway. In addition, the system provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
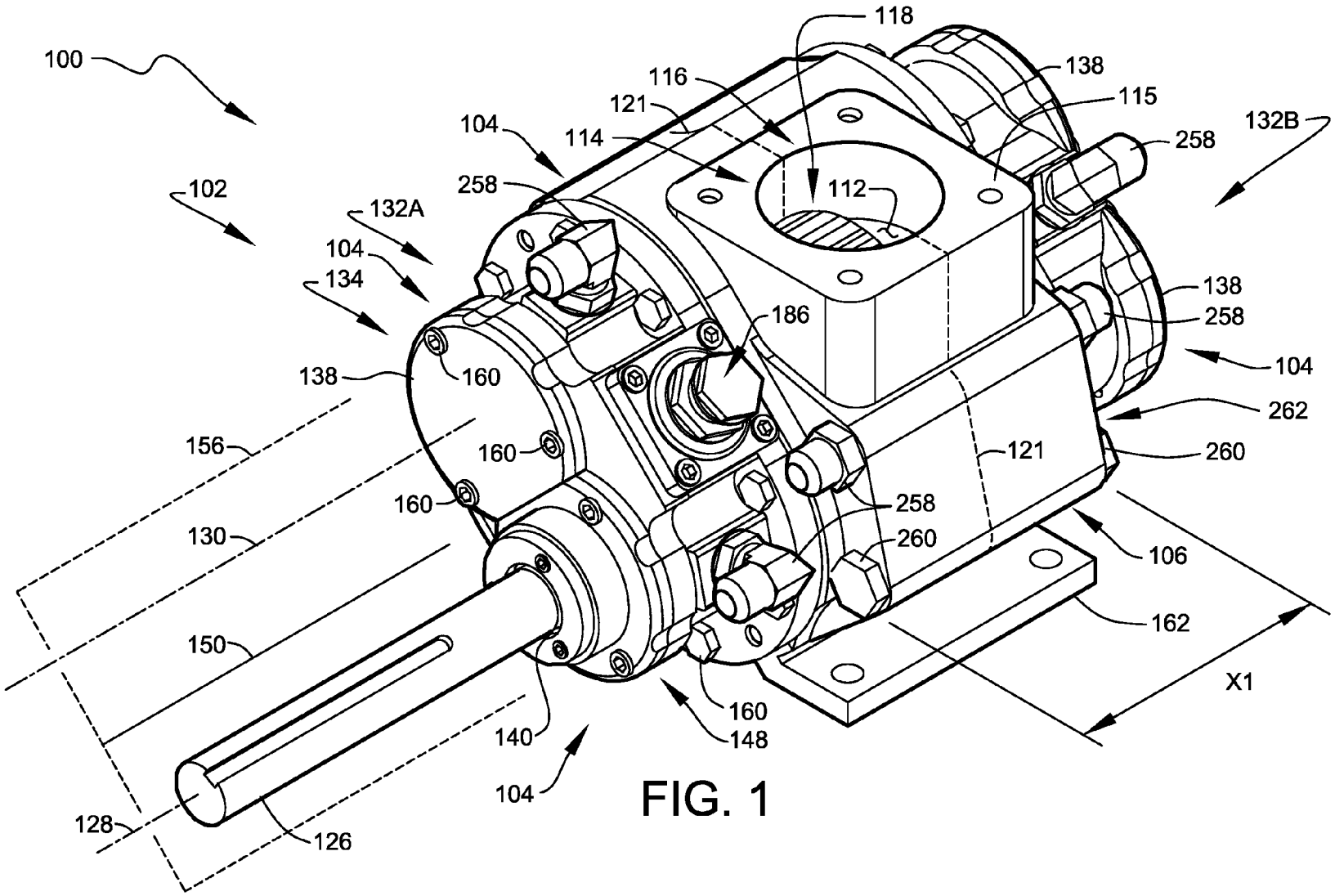
FIG. 1 shows a shaft-side perspective view illustrating a modular-component pump, according to a preferred embodiment of the present invention.
Figure 2:
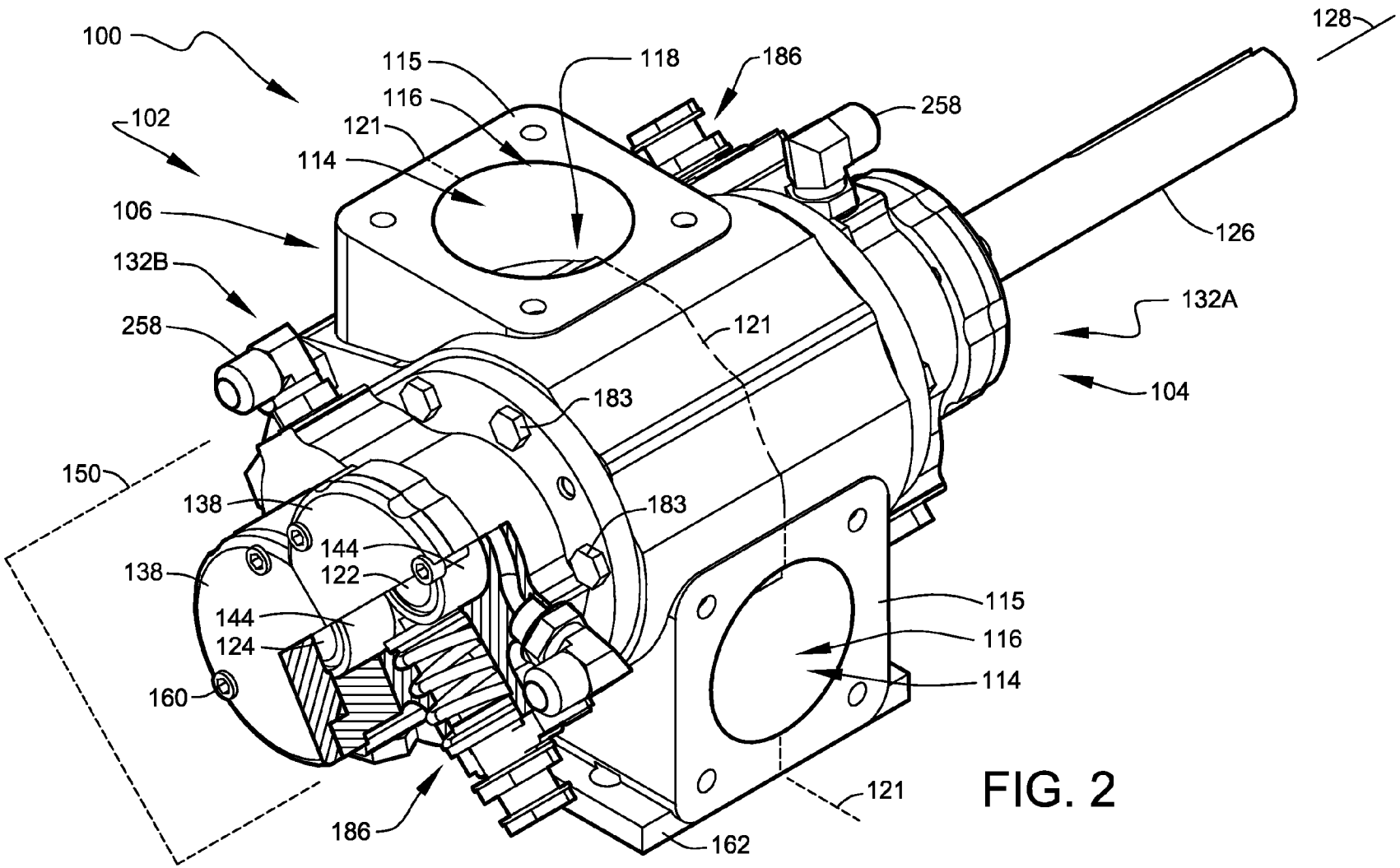
FIG. 2 shows a second perspective view, in partial section, illustrating the modular-component pump, according to the preferred embodiment of FIG. 1.

FIG. 1 shows a shaft-side perspective view illustrating modular-component pump 102, according to a preferred embodiment of the present invention. FIG. 2 shows a second perspective view, in partial section, illustrating the opposing end of modular-component pump 102 of FIG. 1. The depicted modular-component pump 102 is presented as one preferred example embodiment representative of preferred pump embodiments configurable within asphalt pumping system 100.

Modular-component pump 102 is designed to enhance safety and reduce costs associated with the design and implementation of pumping system for viscous molten fluids, such as, hot asphalt and similar bituminous materials. Preferred embodiments of asphalt pumping system 100, preferably including modular-component pump 102, are assembled from groupings of selectable modular components 104 of the system.

Figures 3, 4, 5, 6:
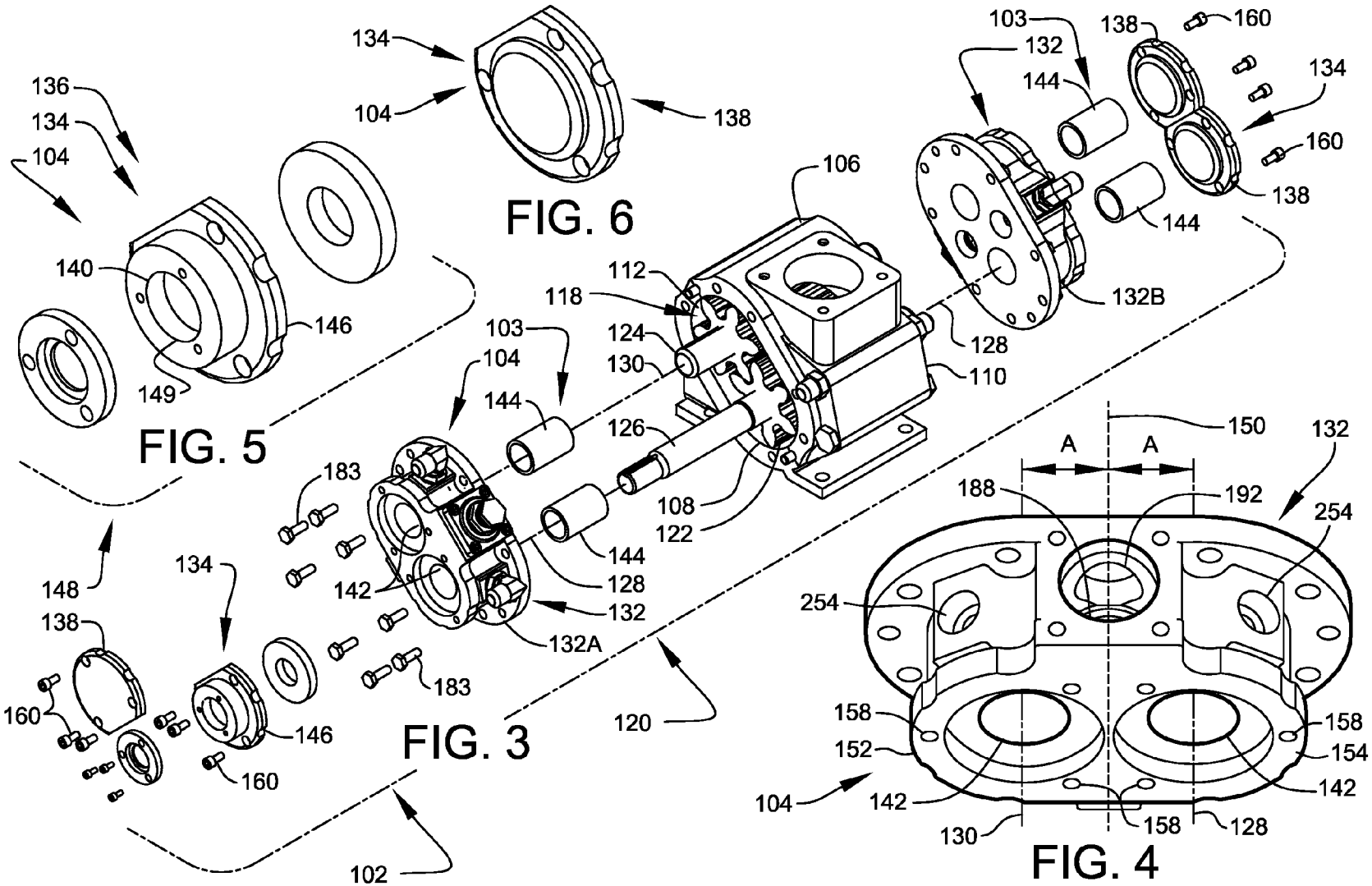
FIG. 3 shows an exploded view of the modular-component pump, according to the preferred embodiment of FIG. 1.
FIG. 4 shows a perspective view, illustrating a single-geometry end unit mountable to a central pump housing of the preferred embodiment of FIG. 1.
FIG. 5 shows an exploded perspective view of a portion of a shaft-type modifier useable to modify the function of a single-geometry end unit to enable rotatable passage of a driveshaft therethrough.
FIG. 6 shows a perspective view of a cover-type modifier useable to modify the function of a single-geometry end unit to cover end portions of the central pump housing, according to the preferred embodiment of FIG. 1.

FIG. 3 is an exploded view showing the preferred grouping of modular components 104 making up modular-component pump 102. It is noted that the illustration of FIG. 3 depicts the major functional components of the system embodiment and omits familiar items such as interstitial gaskets, sealants, etc., which may be applied to the embodiment using methodology customary in the art.

Modular-component pump 102 is preferably organized around a central pump housing 106 having a first open end 108, a second open end 110, and an internal chamber 112 extending therebetween. Preferably, pump housing 106 is roughly bisymmetrical about midline 121, shown using a dashed-line depiction, and may preferably comprise one of several preferred lengths X1 to accommodate differing pump output capacities.

Pump housing 106 is further preferably configured in such manner as to provide a suction inlet 114 and a discharge outlet 116 for the viscous molten fluids. Inlet 114 is preferably configured to inlet the viscous molten fluids to within internal chamber 112 and outlet 116 preferably functions to outlet the viscous molten fluids therefrom. Within the depicted pump embodiment, inlet 114 and outlet 116 are arbitrarily assigned to facilitate the teachings herein. It is noted that modular-component pump 102 is preferably configured to operate equally in forward pumping and reverse pumping operation. The rotational direction of driveshaft 126 determines which of the two ports function as inlet 114 and as outlet 116.

The viscous molten fluid is preferably displaced between inlet 114 and outlet 116 by at least one shaft-driven fluid displacer 118 disposed operably within internal chamber 112, as shown. Shaft-driven fluid displacer 118 is preferably coupled to a power-input shaft identified herein as driveshaft 126. Driveshaft 126 is preferably structured and arranged to operably couple shaft-driven fluid displacer 118 with at least one source of rotational power external of pump housing 106 (such as an electrically-powered motor or similar prime mover).

In a highly preferred embodiment of the system, modular-component pump 102 is of a positive-displacement external gear pump design 120, as shown. As such, shaft-driven fluid displacer 118 preferably comprises a first pumping gear 122 combined with a second pumping gear 124 meshing with first pumping gear 122, as shown. Preferably, both first pumping gear 122 and second pumping gear 124 are disposed rotatably within internal chamber 112 of pump housing 106, as shown. First pumping gear 122 preferably comprises driveshaft 126 that is coaxially aligned along a first rotational axis 128 of first pumping gear 122, as shown. Second pumping gear 124 (functioning as an idler gear) preferably comprises a second rotational axis 130 spaced apart from and generally parallel to first rotational axis 128, as shown.

An innovative feature of the system is the preferred use of the same end component (identified herein as single-geometry end unit 132) to terminate each open end of pump housing 106. FIG. 4 shows a front perspective view, illustrating single-geometry end unit 132 of asphalt pumping system 100. As depicted in FIG. 1 through FIG. 4, first open end 108, second open end 110, and single-geometry end unit 132 preferably comprise a cooperative physical symmetry permitting single-geometry end unit 132 to be operably engaged on either end of the housing in multiple functioning orientations, as shown.

Modular-component pump 102 is preferably assembled by mounting a first single-geometry end unit 132A to first open end 108 of pump housing 106 and a second single-geometry end unit 132B (having a geometric configuration common with first single-geometry end unit 132A) to second open end 110 of pump housing 106, as shown. The preferred symmetrical mounting geometries of pump housing 106 and single-geometry end unit 132 allows first single-geometry end unit 132A and second single-geometry end unit 132B to be fully interchangeable and each may be selectably engaged in at least two functional orientations on either one of first open end 108 or second open end 110. The preferred use of a single-geometry end unit 132 reduces the number of unique components required to form an operational pump, thereby reducing manufacturing, initial acquisition, and in-service operational costs.

Referring to FIG. 4, single-geometry end unit 132 preferably comprises a pair of gear-journal bores 142 structured and arranged to rotatably journal one side of first pumping gear 122 and second pumping gear 124. Each gear journal bore 142 is preferably structured and arranged to interchangeably receive the journal of either of the first pumping gear 122 or second pumping gear 124. Each of the two gear journal bores 142 are preferably machined so as to extend fully through single-geometry end unit 132 to enable the outward passage of driveshaft 126 from internal chamber 112 through the body of the single-geometry end unit 132. Each gear-journal bore 142 preferably comprises at least one friction-reducing bearing 103 having a bearing surface (See FIG. 3). In the preferred configuration of modular-component pump 102, each gear journal bore 142 is preferably machined to accept a plain bearing (also known as plane bearing or a friction bearing) identified herein as bushing 144, as shown. Bushing 144 preferably comprises a plain bearing design consisting of a hollow cylindrical sleeve formed from a metallic bearing material, preferably a bronze alloy. Bushing 144 is preferably press fit or shrink fit to gear journal bore 142 and is preferably retained by interference fit. Preferred embodiments of the system utilize the viscous molten fluids as a bearing lubricant. Preferred embodiments of bushings 144 further utilize lubricating grooves, located within the bushing bore, to assist movement of the viscous molten fluids along the bearing surfaces. This type of design works well when the circulated material has good lubricating qualities as in the case of most common grades of asphalt. Alternately preferably, bearing 103 comprises a roller bearing design, preferably used when pumping abrasive materials such as rubberized asphalt. In this alternate arrangement, the preferred bearing is semisealed from material by means of a labyrinth-type seal system that permits the liquid asphalt to seep through, yet restricts the majority of the abrasive rubber particles. Material small enough to pass through, which is predominantly asphalt, preferably serves to lubricate the bearing.

As illustrated in FIG. 4, single-geometry end unit 132 preferably comprises a first plane of symmetry 150 dividing single-geometry end unit 132 into two equivalent portions identified herein as first-half portion 152 and a second-half portion 154, as shown. First-half portion 152 and second-half portion 154 preferably comprise symmetrically opposite functional geometries, more preferably, substantially identical physical and functional geometries, as shown.

Figure 7:
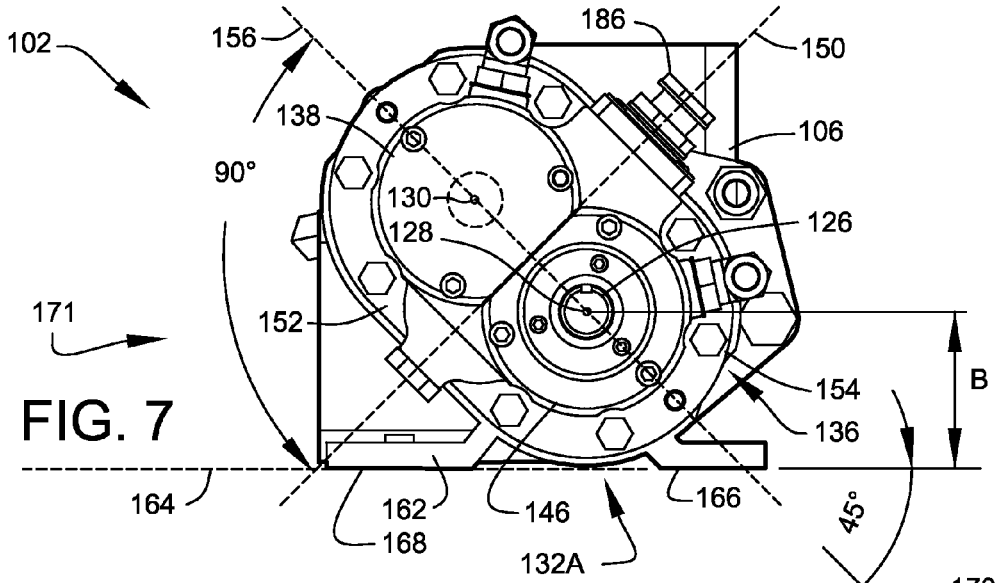
FIG. 7 shows a left-side end view, illustrating the modular-component pump of FIG. 1 comprising a single-geometry end unit modified by a shaft-type modifier assembly to accommodate the passage of rotational drive shaft, according to one preferred embodiment configuration of the present invention.

First plane of symmetry 150 is preferably located about an equal distance A from both first rotational axis 128 and second rotational axis 130, as shown. In addition, first plane of symmetry 150 is oriented about perpendicular (90 degrees) to axis-containing plane 156 containing both first rotational axis 128 and second rotational axis 130 (as shown in FIG. 7). This preferred symmetrical arrangement places one gear-journal bore 142 within first half portion 152 and one gear-journal bore 142 within second half portion 154, as shown.

Asphalt pumping system 100 preferably comprises a set of interchangeable end-unit modifiers 134, each one structured and arranged to interchangeably define the operating function single-geometry end unit 132 when mounted. In more specific terms, single-geometry end unit 132 is preferably modifiable by the application of combinations of interchangeable end-unit modifiers 134 to produce units functioning as either a pump "shaft plate" or a pump "end plate". In the present disclosure, the term "shaft plate" or "drive plate" shall be generally defined as an end-terminating structure of a pump housing adapted to accommodate the rotational passage of a drive shaft. The term "end plate" shall be generally defined herein as an end-terminating structure used to close the open end of a pump housing, with no accommodation for the rotational passage of a drive shaft.

FIG. 5 shows an exploded perspective view of a shaft-type modifier assembly 136 of the set of interchangeable end-unit modifiers 134. Shaft-type modifier assembly 136 is preferably configured to modify the function of single-geometry end unit 132 to enable rotatable passage of driveshaft 126 therethrough. In the depicted modular-component pump 102, shaft-type modifier assembly 136 has been used to modify the function of first single-geometry end unit 132A to comprise a "shaft plate" function, as shown. It is noted that shaft-type modifier assembly 136 is preferably structured and arrange to permit modification of either of first single-geometry end unit 132A or second single-geometry end unit 132B to comprise a sealed drive-shaft passage 140, thereby enabling sealed rotatable passage of driveshaft 126 therethrough.

Shaft-type modifier assembly 136 preferably comprises a radial shaft-seal design (lip seal) preferably comprising an arrangement of annular shaft-seal components 148 including a main shaft plate 146 detachably mountable to either first half portion 152 or second half portion 154 of single-geometry end unit 132. Upon reading this specification, those with ordinary skill in the art will now appreciate that, under appropriate circumstances, considering such issues as cost, intended use, etc., other sealing arrangements such as, for example, packing assemblies, alternate sealing assemblies, alternate bearing arrangements, etc., may suffice.

Main shaft plate 146 preferably comprises a central shaft-passing aperture 149 to enable outward passage of driveshaft through the plate (at least embodying herein at least at least one apertured cap plate having at least one shaft-passing aperture structured and arranged to enable outward passage of such at least one driveshaft therethrough). Shaft-passing aperture 149 (and sealed drive-shaft passage 140) is preferably positioned within the assembly so as to coaxially align with a respective one of the two gear-journal bores 142 when main shaft plate 146 is mounted to either of first half portion 152 or second half portion 154.

In the preferred embodiment of modular-component pump 102, shaft-type modifier assembly 136 preferably includes a single cover-type modifier 138 used to cover the gear-journal bore 142 adjacent main shaft plate 146. Cover-type modifier 138 (at least embodying herein at least one non-apertured cap plate structured and arranged to cover a respective one of such at least two gear-journal bores when such at least one apertured cap plate is detachably mounted to either of such first half portion and such second half portion) preferably omits the shaft-passing aperture of main shaft plate 146. The preferred structures and arrangements of cover-type modifier 138 are described greater detail in FIG. 6.

FIG. 6 shows a perspective view of a cover-type modifier 138 useable to modify single-geometry end unit 132 to comprise an "end plate"-type function. Cover-type modifier 138 preferably comprises a solid cover plate structured and arrange to cover at least one external opening of single-geometry end unit 132 (either first single-geometry end unit 132A or second single-geometry end unit 132B) in fluid communication with internal chamber 112. In modular-component pump 102, two cover-type modifiers 138 are mounted side-by-side to cover the gear-journal bores 142 of first half portion 152 and second half portion 154, as shown.

Single-geometry end unit 132 is preferably configured to enable the mechanical fastening of cover-type modifiers 138 and main shaft plate 146 to either first half portion 152 and second half portion 154, as shown. First half portion 152 and second half portion 154 preferably comprise a symmetrical arrangement of threaded bores 158 adapted to threadably receive a set of threaded anchors 160 passing through a corresponding set of bores within cover-type modifiers 138 and main shaft plate 146, as shown. This preference allows the unit to be readily serviced or reconfigured, should such requirements arise.

FIG. 7 shows a left-side end view of modular-component pump 102 illustrating the bisymmetrical first single-geometry end unit 132A modified by shaft-type modifier assembly 136 to place driveshaft 126 in a low-shaft position 171 relative to mountable support 164, according to one preferred embodiment configuration of the present invention. The preferred symmetry of modular-component pump 102 allows for multiple shaft placements relative to both the inlet/outlet ports and mount 162 of pump housing 106.

Mount 162 is preferably configured to enable firm mechanical mounting of modular-component pump 102 to a mountable support 164 external of modular-component pump 102. Mount 162 preferably comprises a lower contact surface 166, comprising a contact-surface plane 168, which rests adjacent mountable support 164 when modular-component pump 102 is installed. Mount 162 is preferably configured to enable a bolted connection between mount 162 and mountable support 164.

As shown in FIG. 7, pump housing 106 is preferably configured to orient axis-containing plane 156 (containing both first rotational axis 128 and second rotational axis 130), in at least one non-parallel orientation 170 (relative to contact-surface plane 168), as shown. Preferably, such non-parallel orientation 170 geometrically positions one of either of first rotational axis 128 or second rotational axis 130 further from contact-surface plane 168 than the other one of first rotational axis 128 or second rotational axis 130, as shown. This preferred physical arrangement results in the locating of one of the two pumping gears at an elevation higher than the other (relative to a horizontal surface plane 168 located below the pump). In a highly preferred arrangement of the system, pump housing 106 is preferably structured and arranged to orient axis-containing plane 156 at about a 45-degree angle relative to contact-surface plane 168, as shown.

The low-shaft position 171 of FIG. 7 is preferably achieved by engaging main shaft plate 146 (and the associated annular shaft-seal components 148) of shaft-type modifier assembly 136 on the lower of the two halves of single-geometry end unit 132 (in this case second half portion 154), thereby allowing driveshaft 126 of first pumping gear 122 to be located at elevation B above contact-surface plane 168. It is noted that a single cover-type modifier 138 is preferably engaged over the remaining half of single-geometry end unit 132 (in this case second half portion 154).

Figure 8:
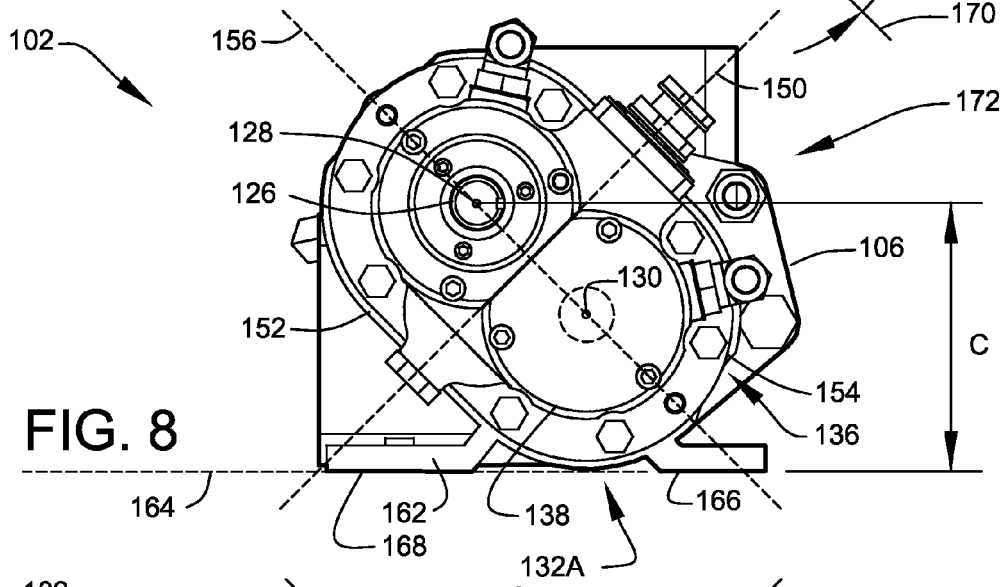
FIG. 8 shows another end view illustrating a single-geometry end unit, of the modular-component pump of FIG. 1, modified by a shaft-type modifier and cover-type modifier to locate the driveshaft in an alternate preferred position, according to another preferred embodiment configuration of the present invention.

FIG. 8 shows the left-side end view of modular-component pump 102 with first single-geometry end unit 132A modified by shaft-type modifier assembly 136 to locate driveshaft 126 in alternate high-shaft position 172. Alternate high-shaft position 172 is preferably achieved by swapping the positions main shaft plate 146 and cover-type modifier 138 to place main shaft plate 146 over the upper of the two halves of single-geometry end unit 132 (in this case first half portion 152) thereby allowing driveshaft 126 of first pumping gear 122 to be located at the higher elevation C above contact-surface plane 168, as shown.

Figure 9:
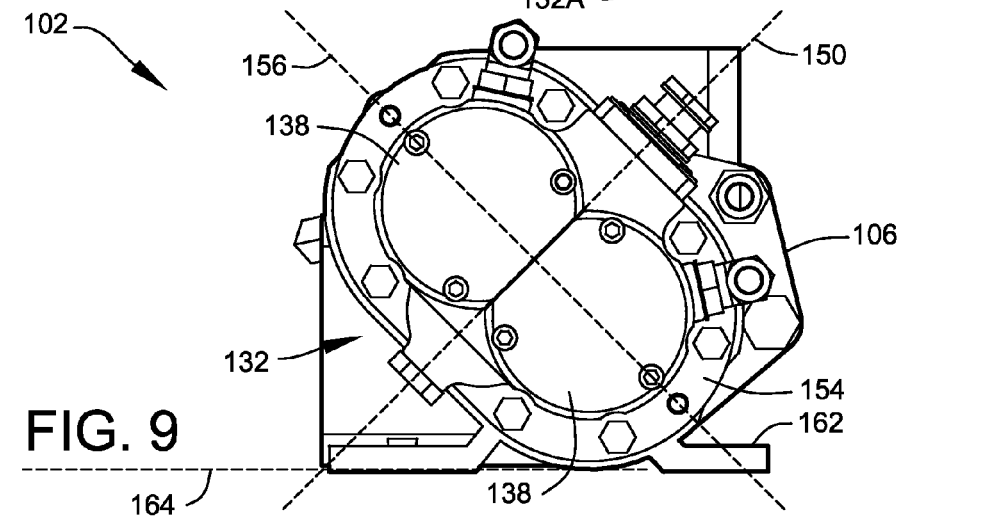
FIG. 9 shows another end view illustrating a single-geometry end unit, of the modular-component pump of FIG. 1, modified by two cover-type modifiers to form a housing end cover, according to one preferred embodiment configuration of the present invention.

FIG. 9 shows another left-side end view of modular-component pump 102 illustrating the mounting of two cover-type modifiers 138 to single-geometry end unit 132, thereby producing a single-geometry end unit 132 comprising an "end plate"-type function, according to one preferred embodiment configuration of the present invention.

Figure 10:
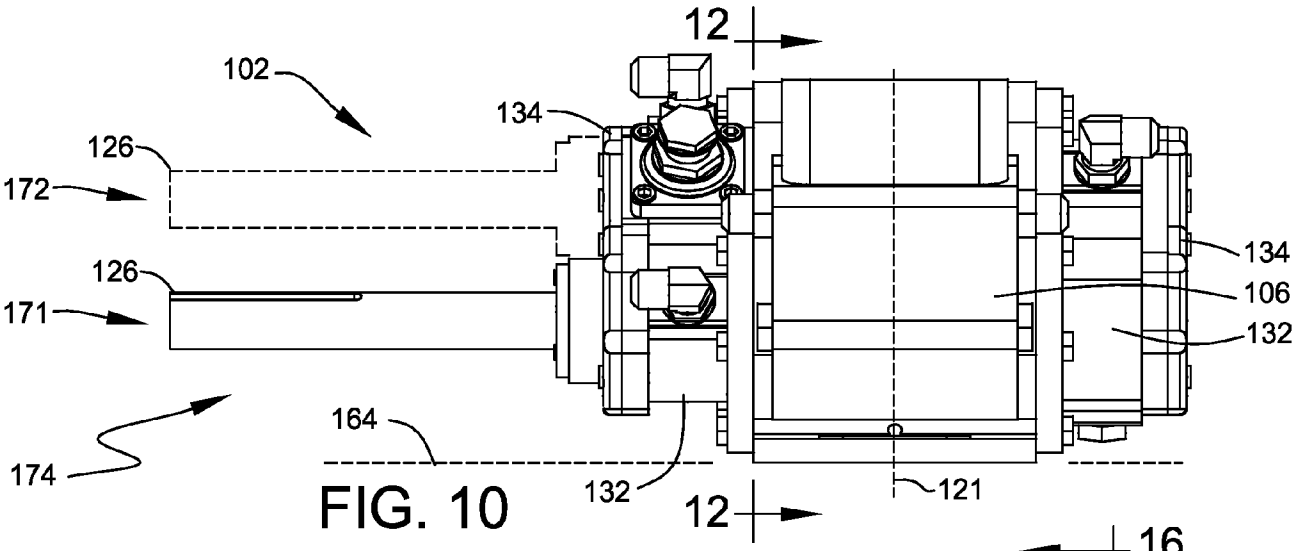
FIG. 10 shows a side elevational view, of the modular-component pump of FIG. 1, illustrating two left-hand shaft positions, according to preferred embodiment configurations of the present invention.
Figure 11:
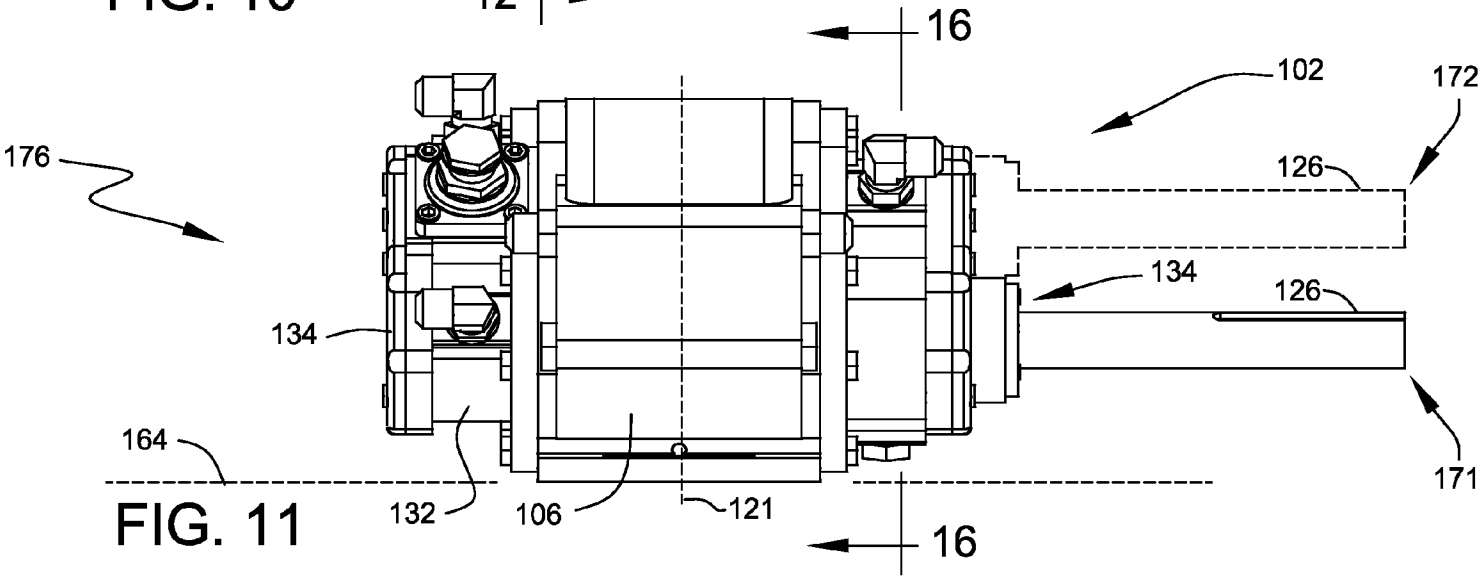
FIG. 11 shows another side elevational view, of the modular-component pump of FIG. 1, illustrating two right-hand shaft positions, according to preferred embodiment configurations of the present invention.

FIG. 10 shows a side elevational view, of modular-component pump 102, illustrating two left-hand shaft positions 174, according to preferred embodiment configurations of the present invention. FIG. 11 shows another side elevational view, of modular-component pump 102, illustrating two right-hand shaft positions 176, according to preferred embodiment configurations of the present invention. As illustrated in FIG. 10 and FIG. 11, the preferred bi-symmetrical physical arrangements of modular-component pump 102 allows the unit to be configurable to at least four unique shaft configurations, using two single-geometry end units 132, as shown.

FIG. 10 shows driveshaft 126 in the two left-hand shaft positions 174 comprising either one low-shaft position 171 or one high-shaft position 172 (shown in dashed-line depiction). In FIG. 11, the functions expressed by the single-geometry end units 132 have been swapped. FIG. 11 now shows driveshaft 126 projecting in the two alternate right-hand shaft positions 176 also comprising one low-shaft position 171 or one high-shaft position 172. Those with ordinary skill in the art will now appreciate that the preferred symmetry and modularity of the above-described system components enable field configuration of each of the four unique shaft configurations using only a first single-geometry end unit 132A, a second single-geometry end unit 132B, and one set of interchangeable end-unit modifiers 134(at least embodying herein wherein at least two left-hand driveshaft configurations, enabling left-hand outward passage of such driveshaft from such pump housing, are field configurable; and wherein at least two right-hand driveshaft configurations, enabling right-hand outward passage of such driveshaft from such pump housing, are field configurable).

Figure 12:
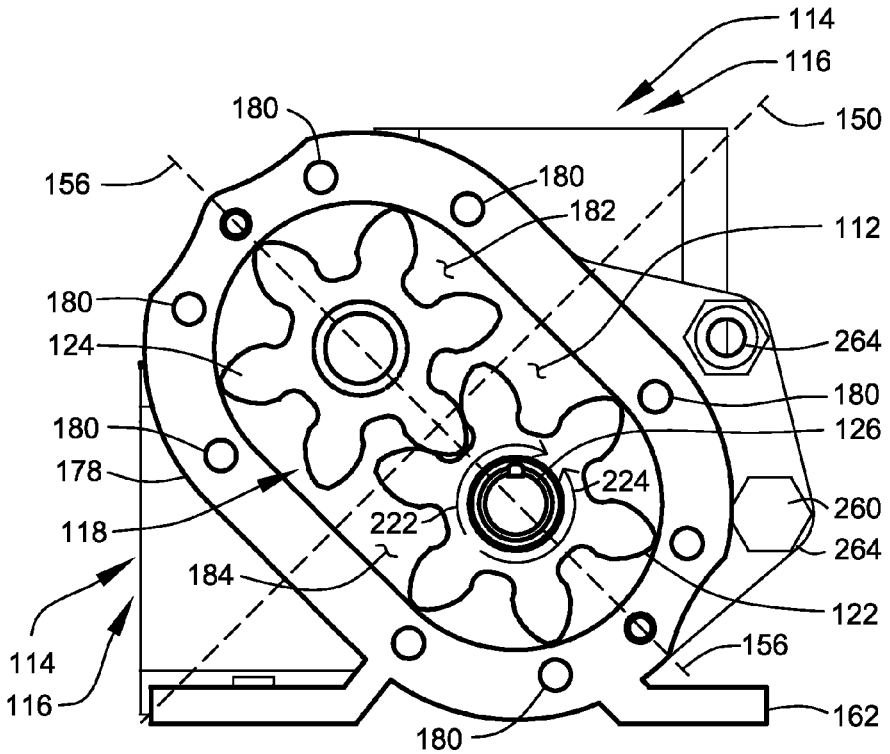
FIG. 12 shows the sectional view 12-12 of FIG. 10, illustrating a shaft-driven fluid displacer disposed within an internal chamber of the central pump housing, according to the preferred embodiment of FIG. 1.

FIG. 12 shows the sectional view 12-12 of FIG. 10, illustrating shaft-driven fluid displacer 118 disposed within internal chamber 112 of pump housing 106, according to the preferred embodiment of FIG. 1. Visible in FIG. 12 is the preferred outer wall 178 configuration of pump housing 106. Outer wall 178 preferably contains a preferred symmetrical arrangement of threaded bores 180 adapted to receive a set of threaded fasteners 183 used to secure single-geometry end unit 132 to pump housing 106 (see also FIG. 3). Threaded bores 180 are preferably arranged symmetrically about both first plane of symmetry 150 and axis-containing plane 156, thereby allowing either one of first single-geometry end unit 132A or second single-geometry end unit 132B to be mounted to pump housing 106 in either of two 180-degree apart orientations.

The shaft-driven fluid displacer 118 formed by first pumping gear 122 and second pumping gear 124 is preferably designed to generate, within internal chamber 112, a suction-pressure region in fluid communication with inlet 114 and a discharge-pressure region in fluid communication with outlet 116. When located within internal chamber 112, first pumping gear 122 and second pumping gear 124 divide internal chamber 112 into first chamber portion 182 and second chamber portion 184, as shown.

In a forward pumping operation (wherein driveshaft 126 is driven in a forward rotation 222), first chamber portion 182 is preferably configured to comprise the suction-pressure region and second chamber portion 184 is preferably configured to comprise the discharge-pressure region. In a reverse pumping operation (wherein driveshaft 126 is driven in reversed rotation 224), first chamber portion 182 is preferably configured to comprise the discharge-pressure region and second chamber portion 184 is preferably configured to comprise the suction-pressure region. It is noted that modular-component pump 102 is preferably configured to operate equally in forward pumping and reverse pumping operation. Thus, the rotational direction of driveshaft 126 preferably determines which of the two chamber portions service inlet 114 and outlet 116.

Figure 13:
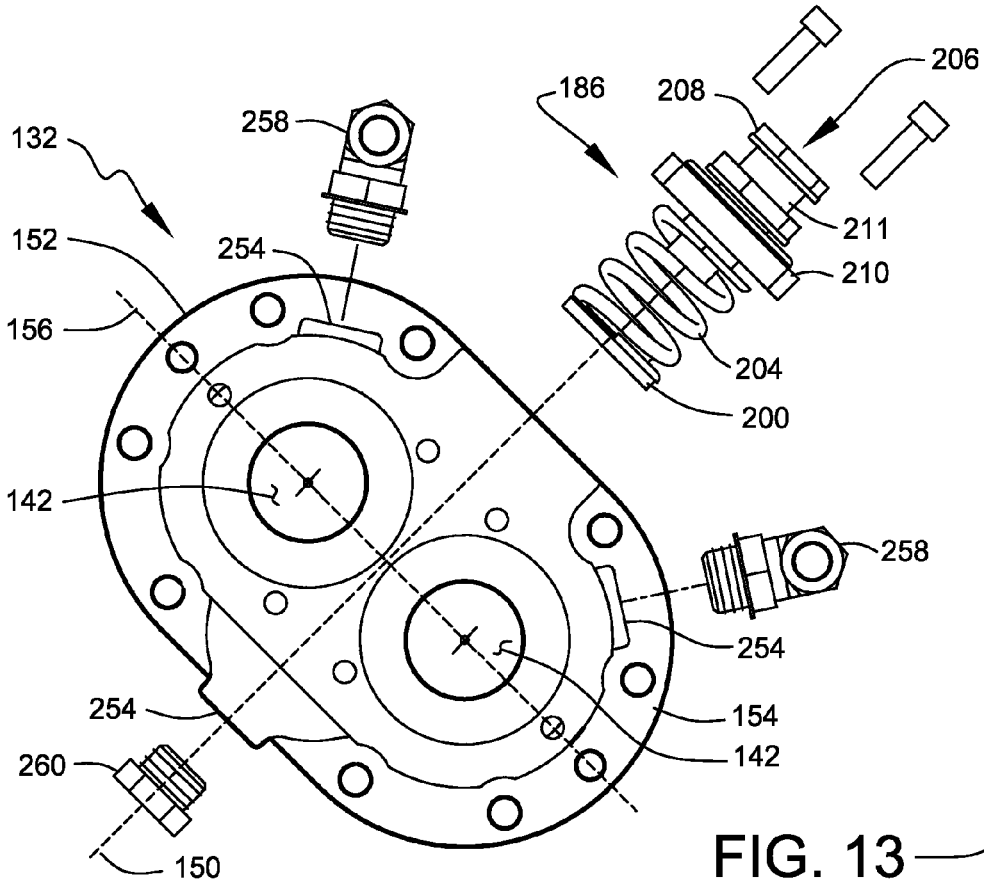
FIG. 13 shows an exploded end view, illustrating preferred functional components of the single-geometry end unit, according to preferred embodiments of the present invention.
Figure 14:
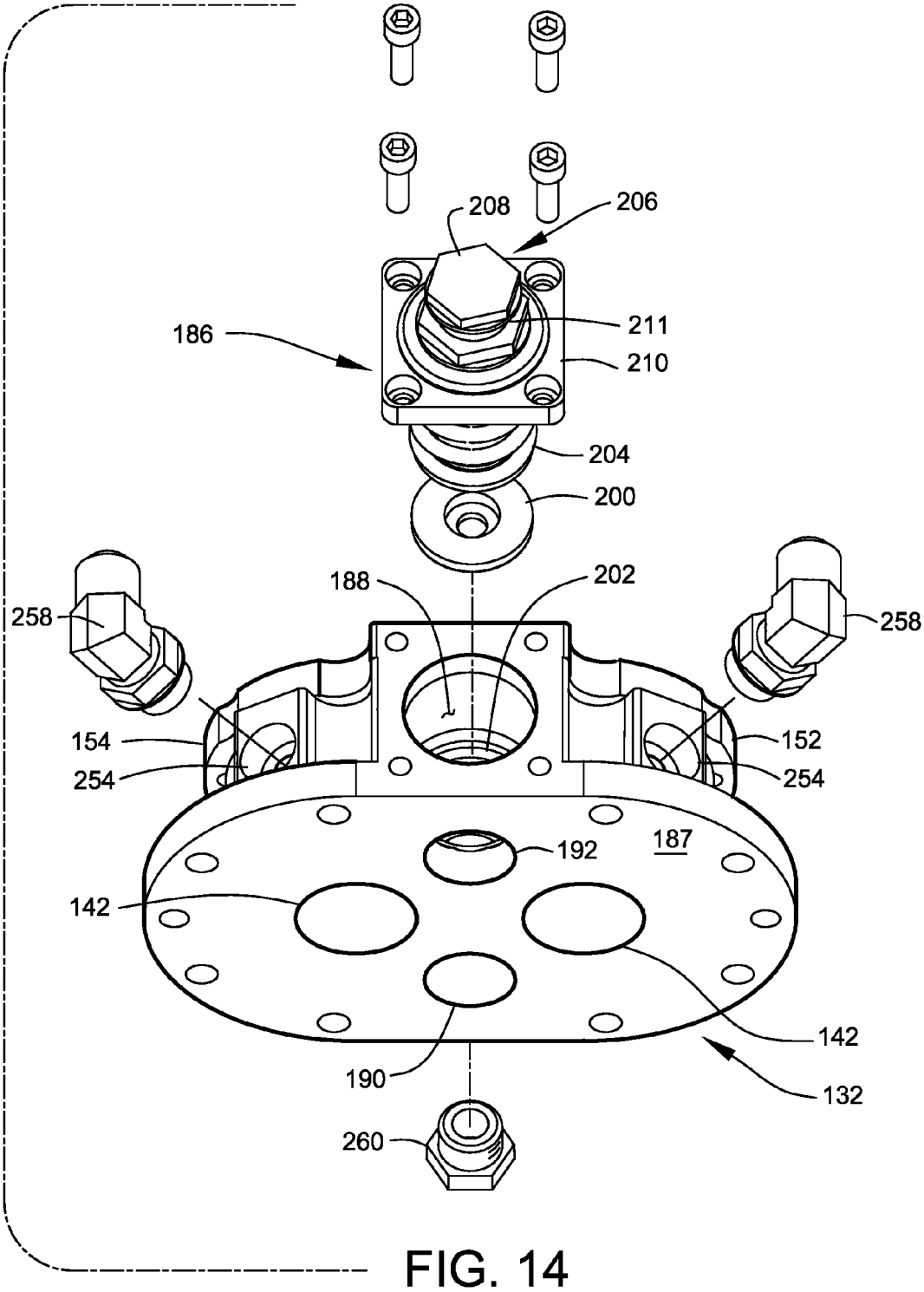
FIG. 14 shows an exploded perspective view, illustrating the rear mating surface of the single-geometry end unit of FIG. 13, according to preferred embodiments of the present invention.
Figure 15:
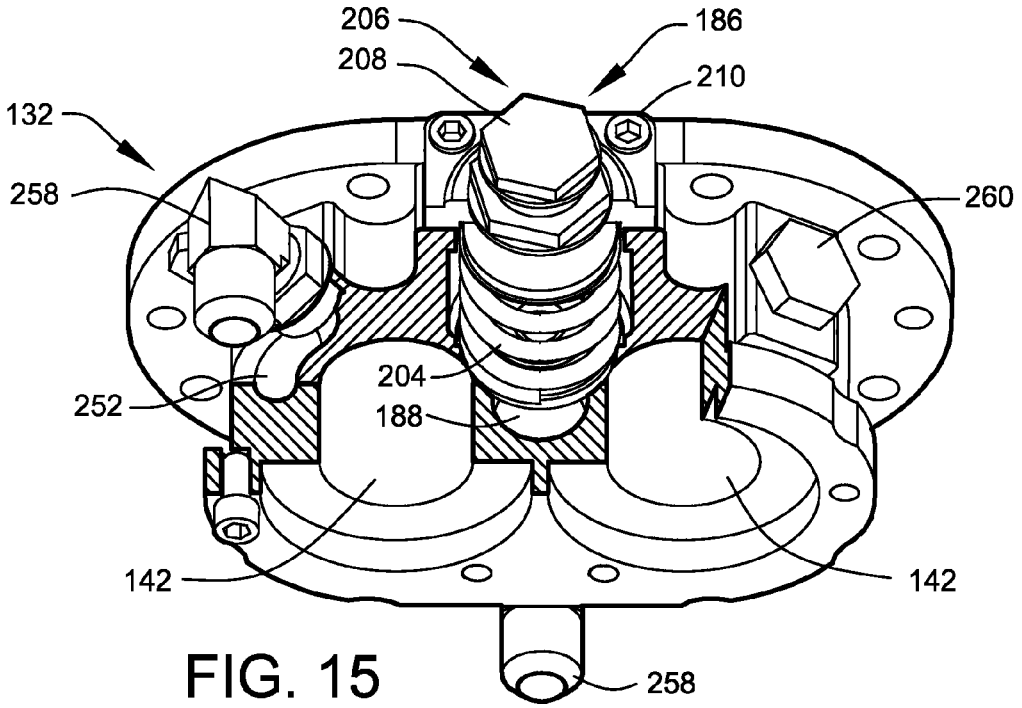
FIG. 15 shows an assembled perspective end view, in partial section, illustrating preferred component relationships of the single-geometry end unit, according to preferred embodiments of the present invention.
Figure 16:
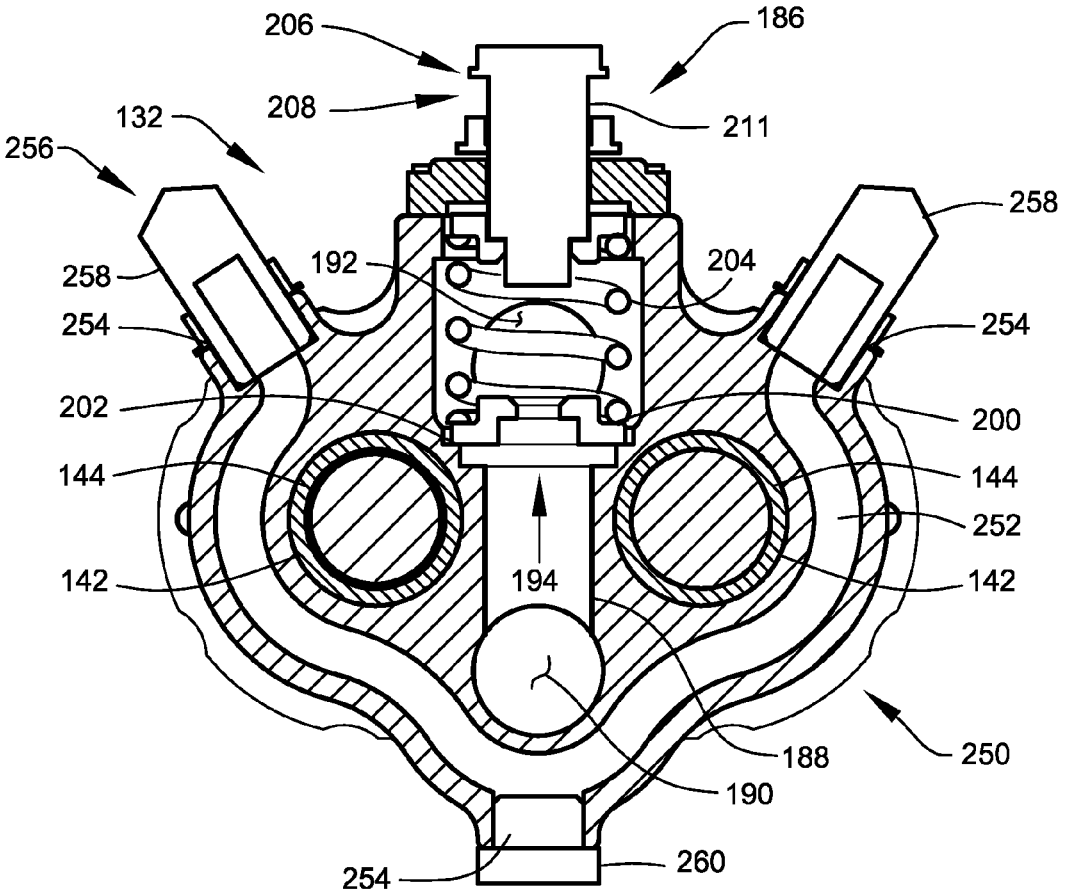
FIG. 16 shows the sectional view 16-16 of FIG. 11, illustrating the internal arrangements of the single-geometry end unit, according to the preferred embodiment of FIG. 1.
Figure 17:
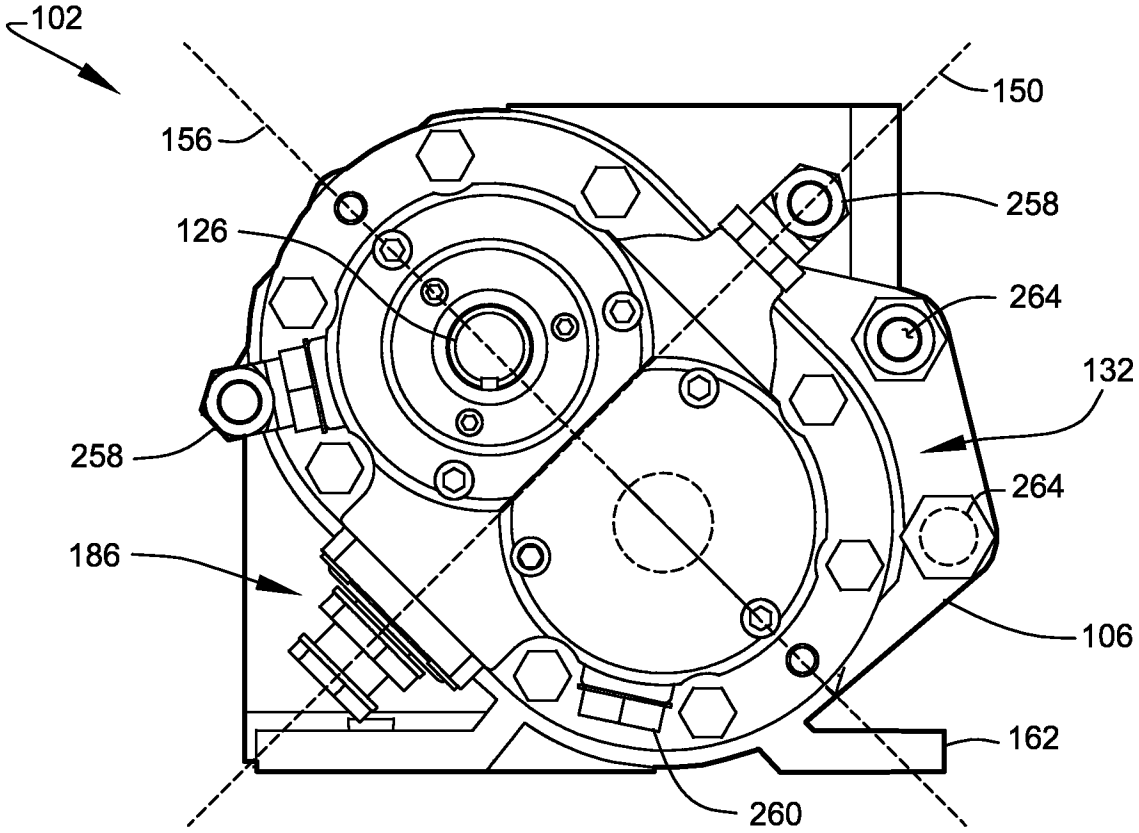
FIG. 17 shows another end view illustrating a single-geometry end unit, of the modular-component pump of FIG. 1, rotated 180-degrees about a first plane of symmetry dividing the single-geometry end unit into a first half portion and a second half portion, according to one preferred embodiment configuration of the present invention.

FIG. 13 shows an exploded end view, illustrating preferred functional components of single-geometry end unit 132, preferably including pressure-relief assembly 186, as shown. FIG. 14 shows an exploded perspective view, illustrating the preferred arrangements of a rear mating surface 187 of single-geometry end unit 132. FIG. 15 shows an assembled perspective end view, in partial section, illustrating preferred component relationships of single-geometry end unit 132. FIG. 16 shows the sectional view 16-16 of FIG. 11, illustrating the internal arrangements of the single-geometry end unit, according to the preferred embodiment of FIG. 1. FIG. 17 shows another end view illustrating single-geometry end unit 132, of modular-component pump 102, rotated 180 degrees about a first plane of symmetry 150, according to one preferred embodiment configuration of the present invention. Reference is now made to FIG. 13 through FIG. 17.

Each single-geometry end unit 132 preferably comprises an integral pressure-relief assembly 186 designed to prevent the pump from developing potentially dangerous fluid-pressure levels during operation, which can arise when portions of the asphaltic materials within the pumping system fail to reach or maintain the necessary molten-fluid state. Each single-geometry end unit 132 preferably comprises a fluid return passage 188 adapted to return a portion of the viscous molten fluids from a respective discharge-pressure region to a respective suction-pressure region. The preferred location and configuration of return passage 188 is best illustrated in the sectional view of FIG. 16.

Fluid return passage 188 is preferably configured to be in fluid communication with both first chamber portion 182 and second chamber portion 184, as shown. Fluid return passage 188 is preferably disposed between each gear-journal bore 142, as shown, and in a position intersecting first plane of symmetry 150.

Fluid return passage 188 preferably comprises return inlet 190, return outlet 192, and a control valve 194 to control passage of the viscous molten fluid between return inlet 190 and return outlet 192, as shown. Single-geometry end unit 132 is preferably configured to be symmetrically mountable to pump housing 106 to selectably locate return inlet 190 and return outlet 192 in fluid communication with either of first chamber portion 182 and second chamber portion 184. FIG. 14 illustrates the preferred symmetrical locations of return inlet 190 and return outlet 192 within rear mating surface 187.

Control valve 194 preferably comprises an adjustable, direct-acting relief valve having a poppet plate 200 held against a valve seat 202 by an adjustable spring 204, as shown. Control valve 194 preferably comprises at least one normally closed position with poppet plate 200 seated against valve seat 202, as shown. In the normally closed position, flow of the viscous molten fluids through fluid return passage 188 is blocked. Control valve 194 is designed to block flow through fluid return passage 188 until the fluid pressure in the discharge-pressure region, acting on poppet plate 200, overcomes the adjustable spring force of spring 204. When the fluid pressure on poppet plate 200 overcomes the adjustable spring force of spring 204, control valve 194 transitions to an open position, thereby enabling one-way flow of the viscous molten fluids between return inlet 190 and return outlet 192. When control valve 194 is in the open position, return circulation of the viscous molten fluids through fluid return passage 188 is enabled between the discharge-pressure region and the suction-pressure region. When fluid pressure in the discharge-pressure region drops below the selected threshold, poppet plate 200 again reseats on valve seat 202 to block the flow of the viscous molten fluids through fluid return passage 188.

Control valve 194 is preferably configured to transition from the normally closed position to the open position in response to an elevated fluid pressure in the discharge-pressure region above at least one selected pressure threshold. Such a selected pressure threshold is preferably adjustable, preferably by adjustment of an externally accessible pressure-threshold selector 206.

Pressure-threshold selector 206 preferably comprises an externally-accessible spring adjuster 208 in operable engagement with spring 204. Spring adjuster 208 preferably comprises a threaded member 211 engaged within valve assembly cover plate 210, which is removably engaged on single-geometry end unit 132, as shown. The threaded member 211 preferably comprises a hexagonal head adapted to receive a wrench or similar tool used to set the position of spring adjuster 208 by threading spring adjuster 208 in and out of valve assembly cover plate 210. Manipulation of spring adjuster 208 preferably adjusts the spring pressure by compressing or relieving the active coils of spring 204, thereby enabling user selection of the selected pressure threshold. Pressure-threshold selector 206 is preferably adjustable to provide cracking pressures ranging between about 10 pounds per square inch (PSI) and about 100-PSI. Upon reading this specification, those with ordinary skill in the art will now appreciate that, under appropriate circumstances, considering such issues as cost, user preference, etc., other relief arrangements such as, for example, non-adjustable valves, mechanically actuated or remotely controlled valves, etc., may suffice.

Figure 18:
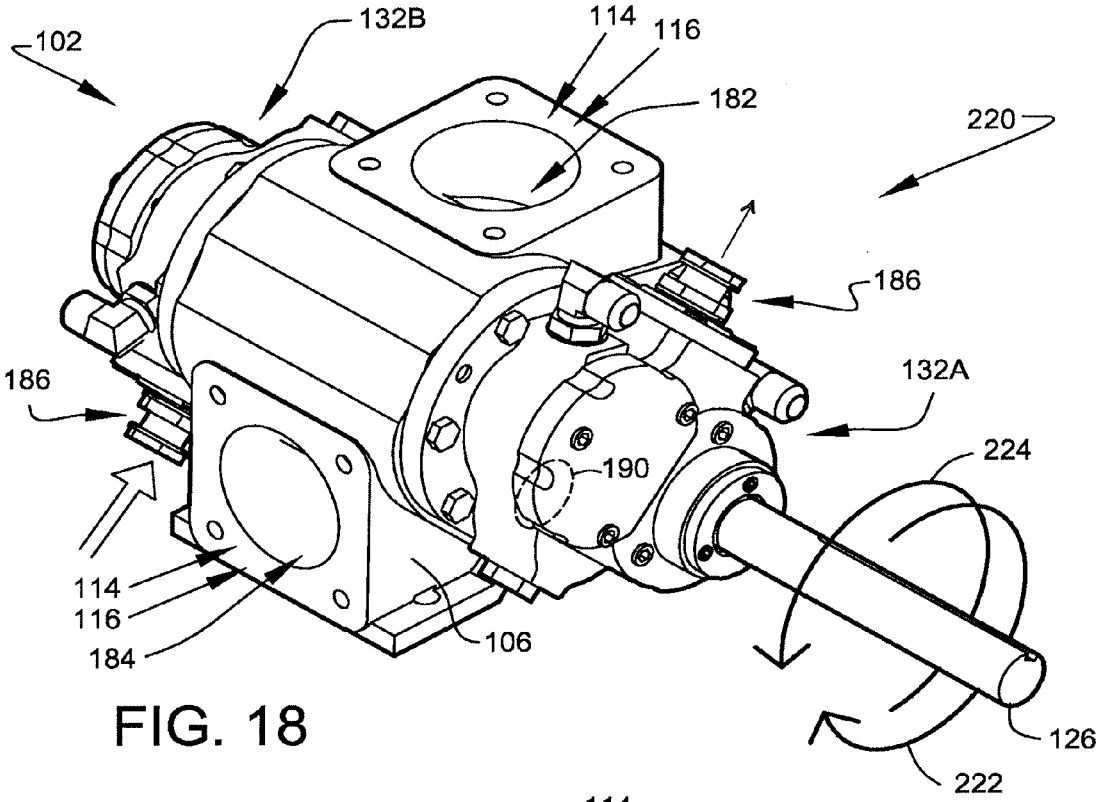
FIG. 18 shows a perspective view, illustrating a preferred arrangement of pressure-relief valves, according to one preferred embodiment of the present invention.
Figure 19:
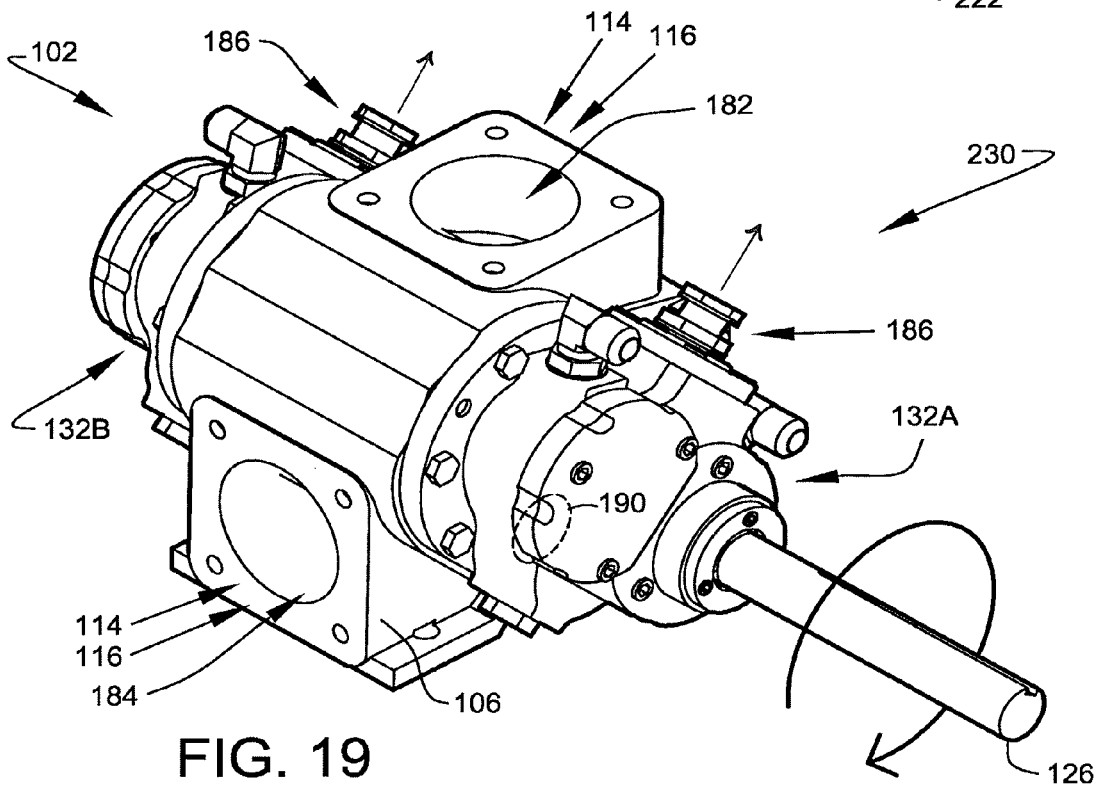
FIG. 19 shows another perspective view, illustrating an alternate preferred arrangement of pressure-relief valves, according to another preferred embodiment of the present invention.

Modular-component pump 102 is preferably capable of being configured in at least three pressure-relieving configurations using two single-geometry end units 132, each containing one pressure-relief assembly 186. It is helpful to recall that each single-geometry end unit 132 can be mounted to either of first open end 108 or second open end 110 in one of two symmetrical orientations. For a given single-geometry end unit 132, the two possible mounting orientations place return inlet 190 of fluid return passage 188 in fluid communication with either first chamber portion 182, as suggested by the configurations of FIG. 7 through FIG. 9, or in fluid communication with second chamber portion 184, as suggested by the configuration of FIG. 17. Thus, modular-component pump 102 is preferably configurable to provide simultaneous pressure-relief control in both forward and reverse pumping operations, by a preferred staggering of the pressure-relief valve orientations of the two opposing single-geometry end units 132. In addition, modular-component pump 102 is preferably configurable to provide high-volume pressure-relief control by aligning the pressure-relief valve orientations of the two opposing single-geometry end units 132. FIG. 18 and FIG. 19 illustrate the above-described relief valve configurations.

FIG. 18 shows a perspective view, illustrating a preferred "staggered" arrangement 220 of pressure-relief assemblies 186, according to a first preferred relief-valve configuration of the present system. In the preferred staggered arrangement 220 of FIG. 18, first single-geometry end unit 132A is preferably mounted to pump housing 106 in an orientation locating return inlet 190, of its respective fluid return passage 188, in fluid communication with second chamber portion 184. Second single-geometry end unit 132B is preferably mounted to pump housing 106 in an orientation locating its return inlet 190 in fluid communication with the first chamber portion 184.

In operation, this "staggered" arrangement of relief valves relieves pressures in both forward and reverse pumping operations, without the need to reconfigure the pump. More specifically, return circulation of the viscous molten fluids is enabled between second chamber portion 184 and first chamber portion 182, through fluid return passage 188 of first single-geometry end unit 132A when a fluid pressure above the selected pressure threshold occurs within a discharge-pressure region developed within second chamber portion 184 by a forward rotation 222 of driveshaft 126. On the opposing end of the pump, return circulation of the viscous molten fluids is enabled between first chamber portion 182 and second chamber portion 184, through fluid return passage 188 of second single-geometry end unit 132B, when a fluid pressure above the selected pressure threshold occurs within a discharge-pressure region developed within first chamber portion 182 by reverse rotation 224 of driveshaft 126 (at least embodying herein wherein at least one of such at least three pressure-relieving configurations comprises forward pressure-relief by a first of such at least one pressure-relief valves during forward pumping operation; and reverse pressure-relief by a second of such at least one pressure-relief valves during reverse pumping operation).

It noted that the pressure-threshold selector 206 of first single-geometry end unit 132A is adjustable independently of the pressure-threshold selector 206 of second single-geometry end unit 132B. For example, a particular application may require the selected pressure threshold of second single-geometry end unit 132B to be adjusted to crack at 80 PSI while the selected pressure threshold of first single-geometry end unit 132A is set to crack at a lower 30 PSI. Upon reading this specification, those with ordinary skill in the art will now appreciate that, under appropriate circumstances, considering such issues as cost, intended use, pump design, etc., other relief valve arrangements such as, for example, omitting or disabling a relief valve at one end of a pump, etc., may suffice.

FIG. 19 shows another perspective view, illustrating alternate aligned arrangement 230 of pressure-relief assemblies 186, according to a second preferred relief valve configuration of the present invention. In preferred alternate aligned arrangement 230, first single-geometry end unit 132 is operably-mounted to pump housing 106 in an orientation locating return inlet 190, of its respective fluid return passage 188, in fluid communication with second chamber portion 184. Second single-geometry end unit 132B is preferably mounted in a preferred orientation locating its return inlet 190 in fluid communication with second chamber portion 184. This "aligned" configuration preferably provides a doubling of the system's return flow volume by combining the bypass flow capacities of the two fluid return passage 188 and pressure-relief assemblies 186. In more specific terms, high-volume return circulation of the viscous molten fluids is enabled between second chamber portion 184 and first chamber portion 182 by a return flow through both fluid return passages 188 of first single-geometry end unit 132A and second single-geometry end unit 132B. This state preferably occurs when the shaft rotation generates the discharge-pressure region within second chamber portion 184 and the fluid pressure within second chamber portion 184 rises to above the selected pressure threshold. In the present disclosure, the term "high-volume return" shall be understood to define the bypass and return of a volume of the viscous molten fluids exceeding the capacity of a single fluid return passage 188 and pressure-relief assembly 186.

The third preferred relief-valve configuration of the present system is a variant of alternate aligned arrangement 230 preferably comprising a 180-degree rotation of the orientations of first single-geometry end unit 132A and second single-geometry end unit 132B on pump hosing 106. This third preferred configuration, enabled by the symmetrical geometry of modular-component pump 102, preferably provides high-volume relief return circulation when a discharge-pressure region is generated within first chamber portion 182 and the fluid pressure within first chamber portion 182 rises to above the selected pressure threshold.

Alternate aligned arrangement 230 is particularly useful in configuring modular-component pump 102 to function as an unloading pump, where high-volume flow rates are utilized during operation. Such unloading operations often utilize flow rates in the range of 300 gallons per minute, exceeding the bypass capacity of a single relief valve.

It is also noted that modular-component pump 102 is preferably adaptable to function as a flow meter to measure the volume of material flow during a handling operation. In this alternate preferred embodiment configuration, it is necessary to disable all relief valve functions, preferably by "bottoming out" the spring adjusters 208 of the pressure-threshold selectors 206.

Each single-geometry end unit 132 preferably comprises at least one fluid-conducting jacket 250 structured and arranged to assist circulation of at least one thermal-transfer fluid, typically heated oil, use to maintain the temperature of the viscous molten fluids within the pump assembly. As best illustrated in the sectional view of FIG. 16, fluid-conducting jacket 250 (at least embodying herein at least one first outer fluid jacket) preferably comprises a continuous internal heat channel 252 (see FIG. 16), symmetrically arranged to surround the gear-journal bores 142, pressure-relief assembly 186, and is preferably located within about one inch (2.54 cm) of the radial shaft-seal assembly of shaft-type modifier assembly 136. Each fluid-conducting jacket 250 preferably comprises three fluid ports 254 in fluid communication with internal heat channel 252 and symmetrically positioned within single-geometry end unit 132, as shown. Each fluid port 254 is preferably configured to receive a threaded fitting 256, preferably comprising a hose-type coupling 258 or threaded cap 260 (FIG. 17), as shown.

Pump housing 106 is similarly configured to comprise at least one outer fluid jacket 262, as best illustrated in FIG. 1. Outer fluid jacket 262 (at least embodying herein at least one second outer fluid jacket) is also configured to assist in maintaining the temperature of the viscous molten fluids through the circulation of heated oil within pump housing 106. Outer fluid jacket 262 preferably comprises an arrangement of integral passages located within outer wall 178 and accessed via a plurality of external fluid ports 264, as shown. Each external fluid port 264 is preferably configured to receive a threaded fitting 256, preferably comprising a hose-type coupling 258 or threaded cap 260, as shown.

At start-up, the entire pump, including the pressure-relief assembly 186, is filled with cold asphalt. In the preferred embodiments of the present invention, pressure-relief assembly 186 is preferably located adjacent a fluid-conducting jacket 250, as shown, and is preferably configured to be heated by the thermal-transfer fluid circulating therein. If pressure-relief assembly 186 was not heated, the assembly would have to scavenge heat from remote components of the pump possibly resulting in initial operation of the pump with the pressure-relief assembly immobilized by solidified asphalt. If the system were to be plugged downstream, fluid pressure could build to dangerous levels. What commonly happens in this circumstance is the electrical circuit breaker of the drive motor overloads to stop the pump; however, before the breaker trips, the pressure may build well beyond the intended relief pressure setting. This is a dangerous condition and over time contributes to wear and tear on the pump, motor, and all valves and flange joints between the pump and the offending stoppage.

The preferred heat-jacketed single-geometry end unit 132 (shown in FIG. 16) insures that the asphalt left in fluid return passage 188 of the relief valve re-liquefies before the overall pump assembly "thaws" enough to rotate. In doing so, the system not only insures that the pump relieves at its intended pressure setting, but it also becomes a valuable tool to the overall start-up procedure. In the preferred arrangements of the system, the thermally-heated pump assembly preferably maintains a safe level of pressure (about 80 PSI) by providing a means for assuring the early operation of the heated pressure-relief assembly 186 to allow the pump to maintain lower initial inlet pressure levels and without risk of overloading the electric motor. Cold slugs that generally reside between components, such as flange joints, are slowly pushed into the jacketed pipe, at which point they liquefy as they enter a heated region of the fluid pathway.

The inherent flexibility of configuration provided within asphalt pumping system 100 allows the system to produce multiple embodiments ranging from small tack-truck pumps, larger truck pumps, plant pumps, up to and including high-volume off-loading pumps. Preferred embodiment of the system may also be configured as metering pumps by adapting a metering device to driveshaft 126.

Concurrent with the development of the above-described preferred embodiments of the present system, Applicant conceived a particularly beneficial gear geometry that was found to produce unexpected reductions in the amplitudes of flow pulsations. More specifically, Applicant's preferred "phase-balanced" gear geometry was found to significantly reduce or functionally eliminate cyclic non-uniformity in output pressure and volume during operation. Empirical testing showed significantly lower pressure amplitudes for any given pump speed, without significant measurable losses in pump performance. Thus, preferred embodiments of asphalt pumping system 100 include features directed to the reduction of pulsation pressures within the output flow of the pump along with a reduced tendency of specific pump configurations to exhibit cavitation at higher operation speeds.

Pulsations in the output flow of conventional positive displacement pumps are an inherent feature of their operation. The pulsation behavior of such pumps is directly related the number of gear teeth supplied within the pumping gears of the fluid displacer. For example, a conventional external gear pump having twelve teeth (that is, two gears each with six teeth) will create twelve pulses in each 360-degree revolution. Thus, a conventional pump rotating at 400 revolutions per minute (RPM) will generate 4800 pulses per minute in the output flow.

A conventional gear pump creates displacement when the solid tooth of one gear enters the adjacent root of the other gear and displaces the liquid. The pulse is created when the total liquid displaced throughout the engagement is not linear. More specifically, a six-tooth gear will displace six root chambers per 360-degree revolution; each chamber being preferably located at equal 60-degree intervals. During the discharge of one 60-degree root, less than half of the total discharge is completed during the first and last halves of the rotation, while more than half is completed in the mid portion. As a result, the material flows out of the pump in a pulsing flow that amounts to the 12 pulses per revolution noted above.

Figure 20:
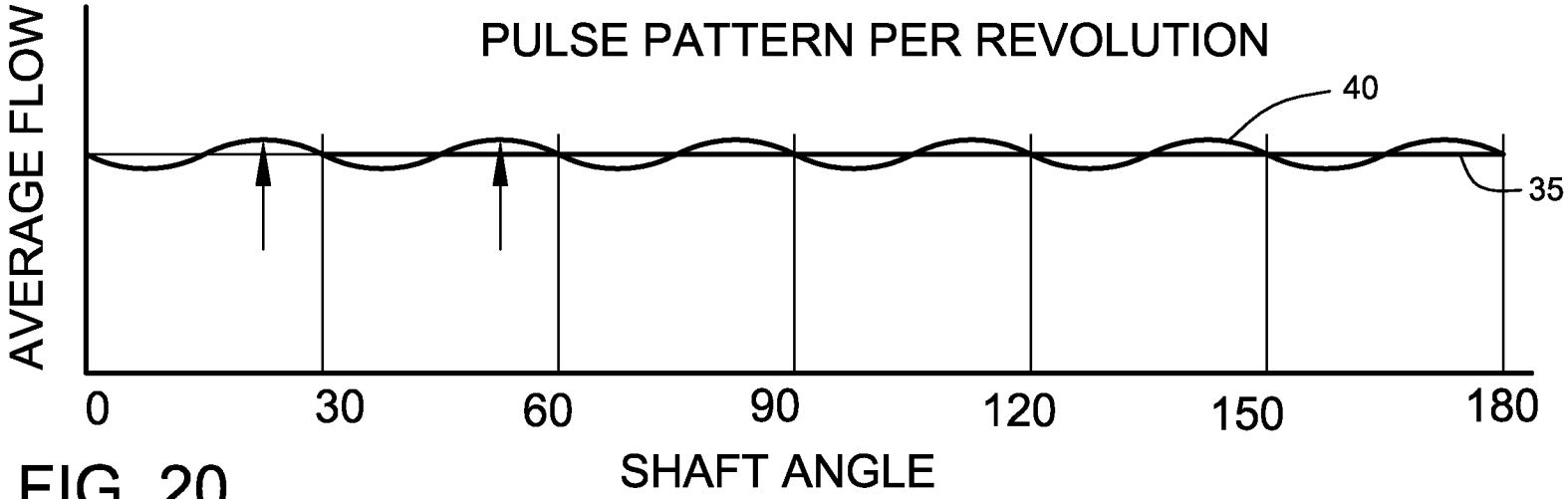
FIG. 20 shows a diagram illustrating a typical pressure ripple measured at the fluid discharge during 180 degrees of gear revolution.

FIG. 20 shows a diagram illustrating a typical pressure ripple at the fluid discharge of a conventional pump during 180 degrees of shaft rotation. When the conventional pump is producing an averaged output flow of 100 gallon per minute (GPM), as indicated by a flat line 35 representing the average output flow, in reality the pump is outputting at a variable rate, as indicated by the sinusoidal line 40 depicting the cyclic changes of amplitude of the output flow. Many pump-dependent processes operate most effectively when supplied with relatively uniform flow volumes and pressures. Non-uniformity in pump output often hinders or prevents optimization of such pump-dependent system and processes. For example, certain high-accuracy metering devices are adversely affected by pump pulsations, which can limit their measurement accuracy when used with conventional gear pumps. The preferred "pulse-cancelling" embodiments of asphalt pumping system 100, as described herein, are preferably configured to reduce the measurable amplitude of such pulsations and similar non-uniformities in pump output.

Figure 21:
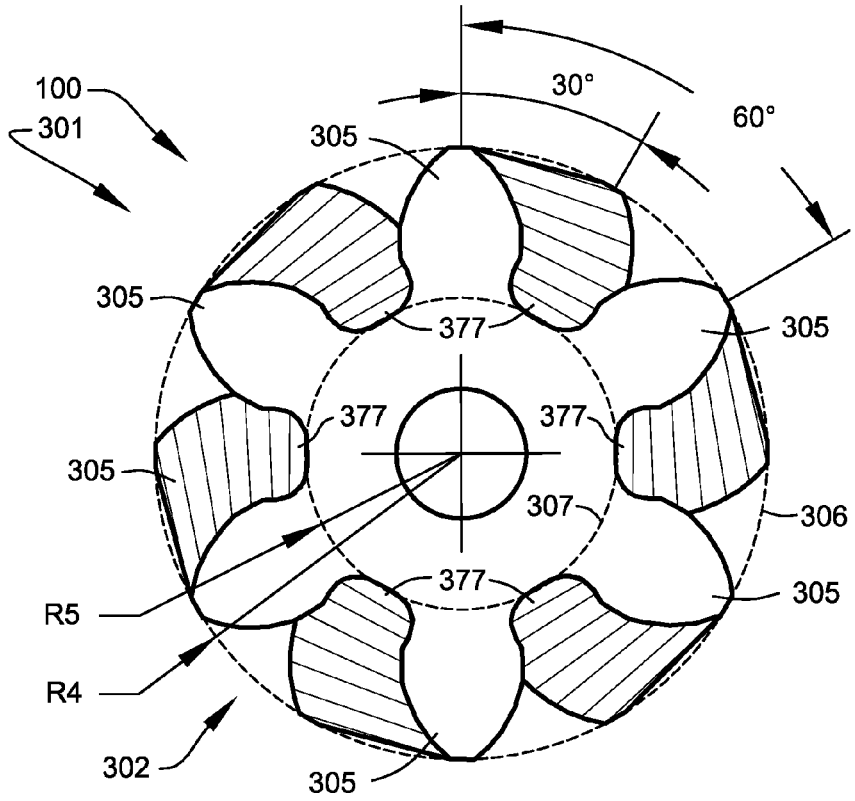
FIG. 21 shows a diagrammatic end view of a phase-balanced gear according to another preferred embodiment of the present invention.
Figure 22:
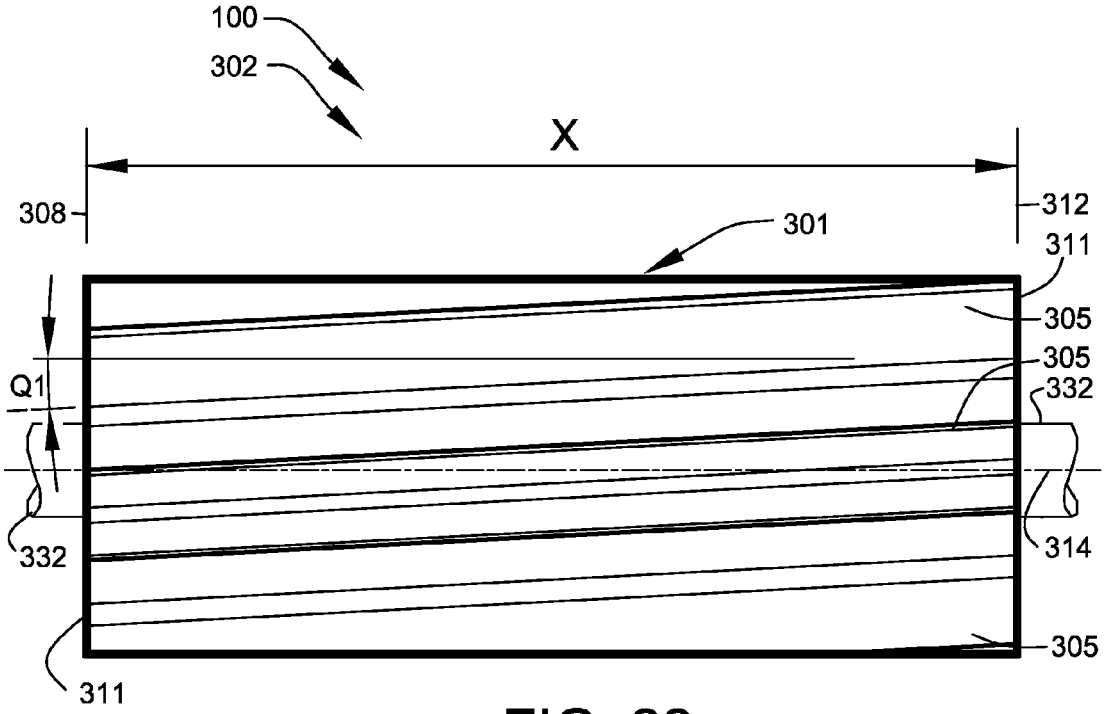
FIG. 22 shows a side view, generally illustrating one preferred helical gear geometry of the pulse-cancelling positive pressure gear pump of FIG. 21.

FIG. 21 shows a diagrammatic end view of Applicant's phase-balanced gear 301 comprising a preferred phase-balanced gear geometry 302, according to another preferred embodiment of the present invention. FIG. 22 shows a side view illustrating the preferred helical gear geometry of phase-balanced gear 301, according to the preferred embodiment of FIG. 21.

Preferred pulse-reduction embodiments of asphalt pumping system 100 utilize two principal means for reducing pulsations within the output flow; the first is related to gear geometry, as described in FIG. 21 and FIG. 22, the other is related to actively-controlled shunting of fluid pressures between the discharge and suction regions of the pump. Both arrangements may preferably be used independently to reduce non-uniformity in output flow; however, the greatest benefits were demonstrated by combining these improvements within a single apparatus, as further described below.

In regard to manipulation of gear geometries, Applicant determined that a specific combination of gear length and helix angle have a direct affect on the amplitude of each pulse. The longer the gear, the more it was found to dilute (or lower) the pulse amplitude. Consequently, longer gears resulted in lower pulse amplitude, a stabilized flow, and higher production rates. Further improvements were achieved preferably by establishing a specific relationship between the gear length angle of the helical gear teeth 305.

Referring to FIG. 21 and FIG. 22, each phase-balanced gear 301 preferably comprises a set of helical gear teeth 305 preferably defining an outer addendum circle 306 and an inner root circle 307, as shown. An opposing pair of gear faces 311, identified herein as gear face 308 and gear face 312 preferably terminates each end of the set of helical gear teeth 305 and defines the face-to-face tooth length X, as shown in FIG. 22.

Preferably, each terminating gear face 311 is oriented transversely to rotation axis 314 of phase-balanced gear 301, as shown. Within each gear, the set of helical gear teeth 305 are preferably arranged to comprise a helix angle Q1, relative to such rotation axis 314, as shown. Helix angle Q1 is preferably selected to provide exactly a one-half tooth pitch rotation from gear face 308 to the opposing gear face 312. This preferred arrangement was found to measurably reduce the fluid pressure pulses essentially by pulse-pressure cancellation. More specifically, Applicant has measured significant reductions in pump pulsation when the helical angle Q1 of the gear produces an exact half-tooth rotation along length X, as shown.

Each phase-balanced gear 301 preferably comprises a generally cylindrical-shaped pump gear having helical teeth 305 disposed at angle Q1 of about three degrees relative to axis 314 and a tooth length X of about ten inches (25.4 cm). In the six-tooth gear of FIG. 21, this preferred geometry establishes an end-to-end tooth rotation of about 30 degrees. In the six-tooth gear of FIG. 21, outer addendum circle 306 comprises a preferred radius R4 of about 4.9 inches (12.446 cm) and inner root circle 307 comprises a preferred radius R5 of about 2.5 inches (6.35 cm). Upon reading this specification, those with ordinary skill in the art will now appreciate that, under appropriate circumstances, considering such issues as intended use, cost, fluid viscosity, etc., other gear arrangements such as, for example, longer gear lengths, alternate tooth pitch, alternate number of teeth, alternate gear diameters, etc., may suffice. It is further noted that Applicant developed the preferred gear designs through experimental testing assisted by rapid fabrication techniques, preferably enabled by computed numerically controlled (CNC) machine tool apparatus, preferably automated using one or more computer aided drafting programs.

Figure 23:
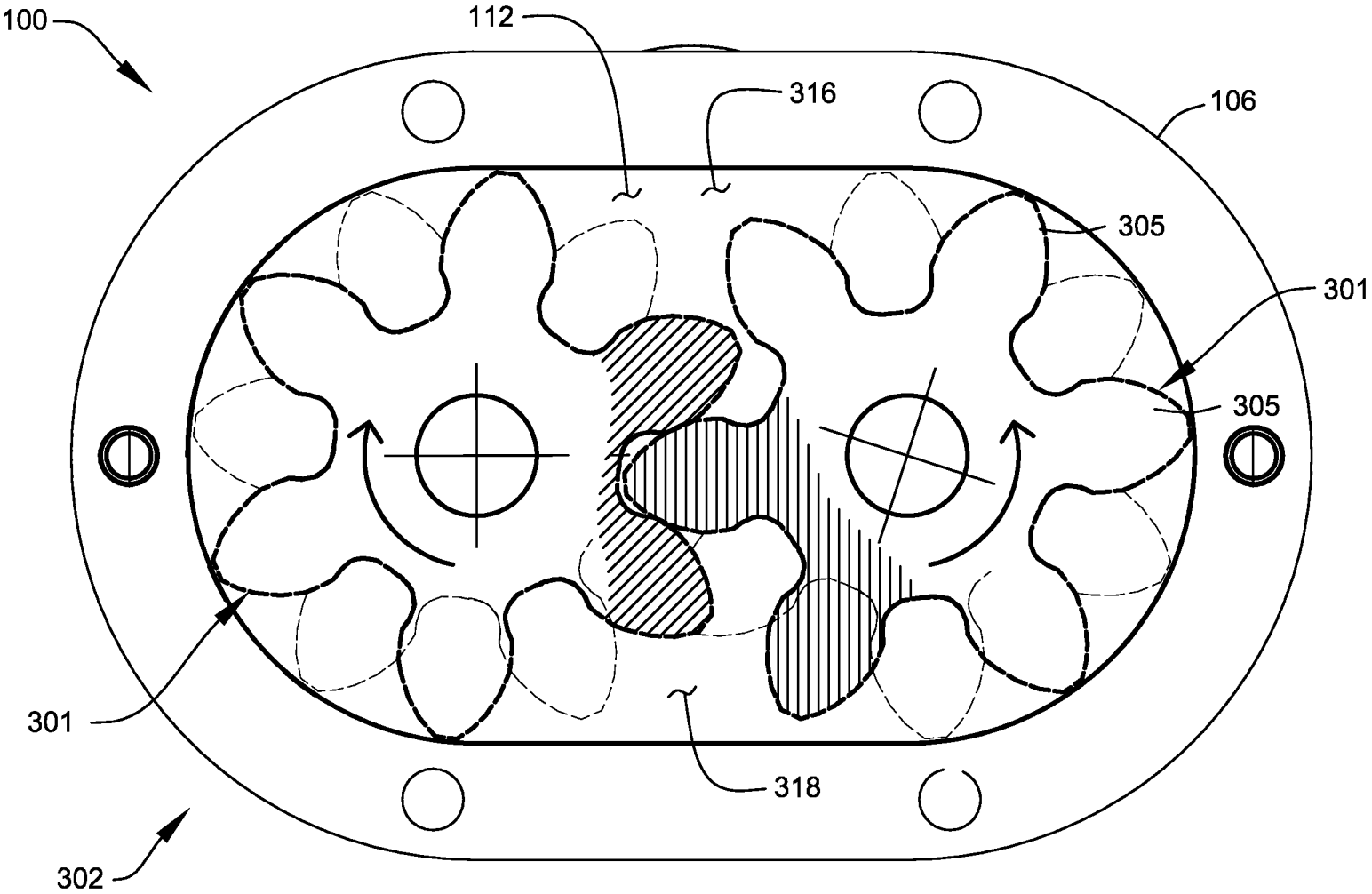
FIG. 23 shows a diagrammatic cross-sectional view, of a pulse-cancelling positive-pressure gear pump, according to another preferred embodiment of the present invention.

FIG. 23 shows a diagrammatic end view, of a pulse-cancelling positive-pressure gear pump 300 preferably utilizing phase-balanced gears 301, according to a preferred embodiment of the present invention. In the depiction of FIG. 23, the end unit covering the open end of pump housing 106 has been omitted from the view to more clearly present Applicant's preferred arrangement of intermeshing phase-balanced gears 301. Preferably, the set of intermeshing phase-balanced gears 301 are rotatably disposed within the internal chamber 112 of pulse-cancelling positive-pressure gear pump 300 and preferably divide chamber 112 into a discharge-pressure region 316 and suction-pressure region 318. It is noted that only forward pump rotation will be described for simplicity of explanation; however, it is noted that the preferred pump embodiments described herein are preferably adapted to operate in both forward and reverse directions.

It is Applicant's assertion that the preferred half-helix geometry of the gears creates a phase discharge balance during operation; that is, when one end of the gear is at maximum discharge, the opposing end is at minimum discharge. This preferably establishes a "back-and-forth" reciprocal action that repeats continuously as the pump rotates. The net downstream result is a "cancellation" of the pulse resulting in a steady stabilized flow. Such balanced flow has many benefits, one being an output flow that can be more accurately metered by a mass-flow metering device. Such pulse-pressure cancellation within the pump preferably removes contradictory sensor readings in the metering device by eliminating pulsation forces acting on the sensors of the meter.

In a further preferred refinement to pulse-cancelling positive-pressure gear pump 300, Applicant developed an effective secondary fluid-pressure control mechanism that, when utilized in conjunction with gear geometry 302, was demonstrated to further reduce pulsation pressure amplitudes within both the outlet pressure and the inlet vacuum profiles. Identified herein as pulse-canceling circuit 330, the refinement preferably functions to actively attenuate primary pump pulsations by the timed opening of a fluid passage between the discharge-pressure region 316 and the suction-pressure region 318 of internal chamber 112.

Figure 24A:
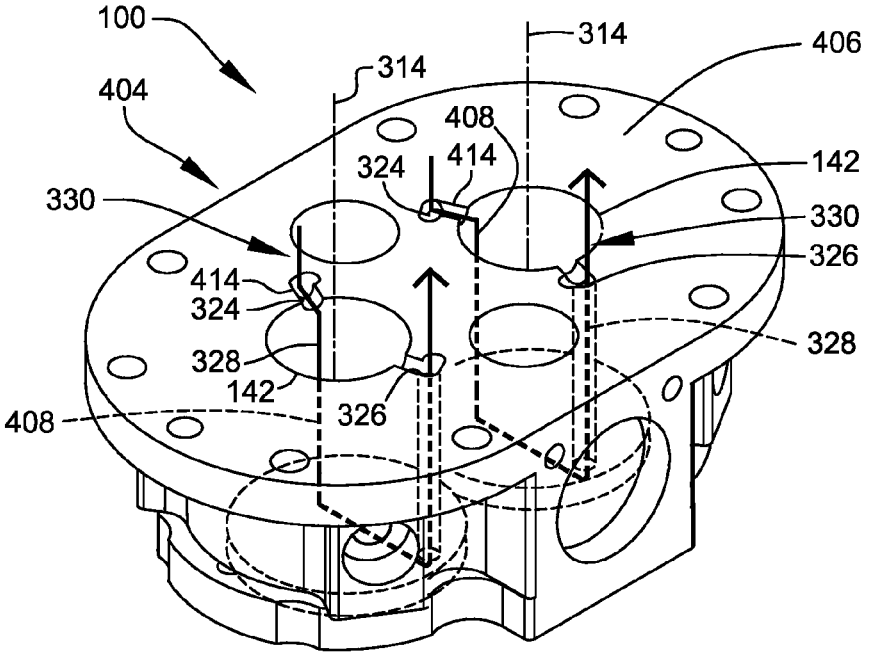
FIG. 24A shows a perspective view, illustrating the inner face of an alternate end plate having secondary "pulse cancelling" features, according to another preferred embodiment of the present invention.
Figure 24B:
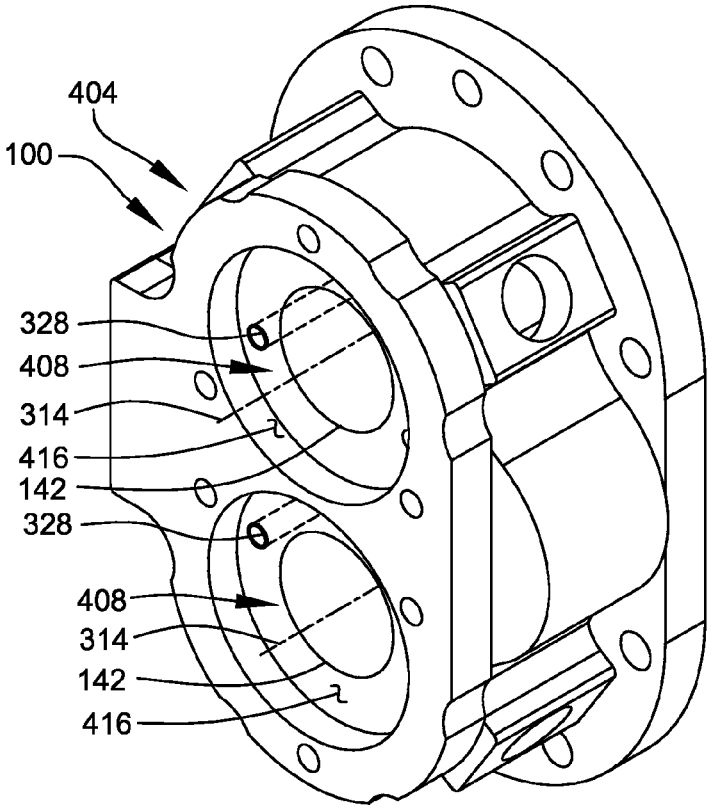
FIG. 24B shows a perspective view, illustrating the outer side of the alternate end plate of FIG. 24A.
Figures 24C, 24D:
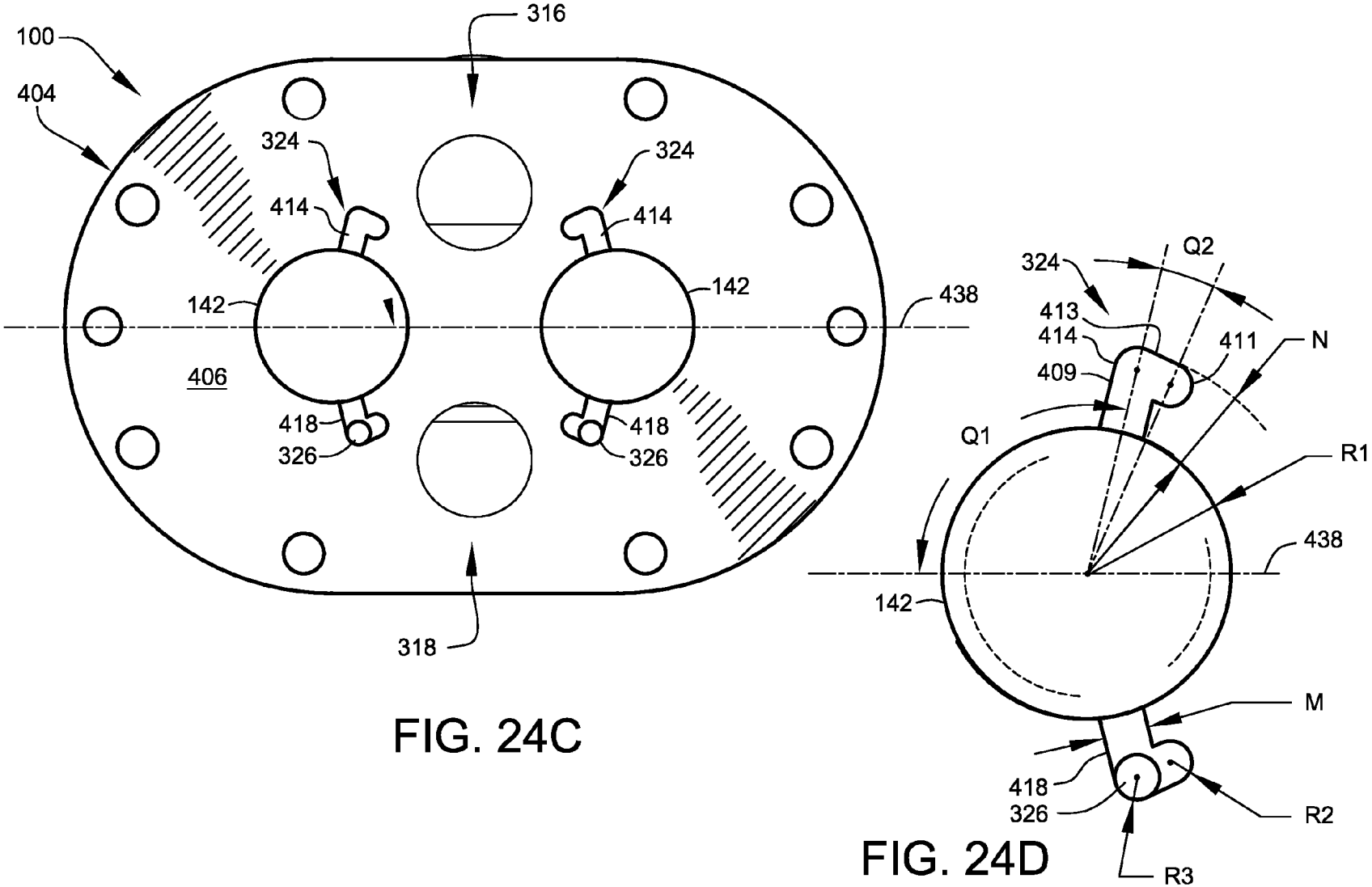
FIG. 24C shows an elevational view, illustrating the inner side of the alternate end plate of FIG. 24A.
FIG. 24D shows a shows a partial elevational view, magnified for clarity, illustrating an arrangement inlet and outlet channels of the alternate end plate of FIG. 24A.
Figure 25:
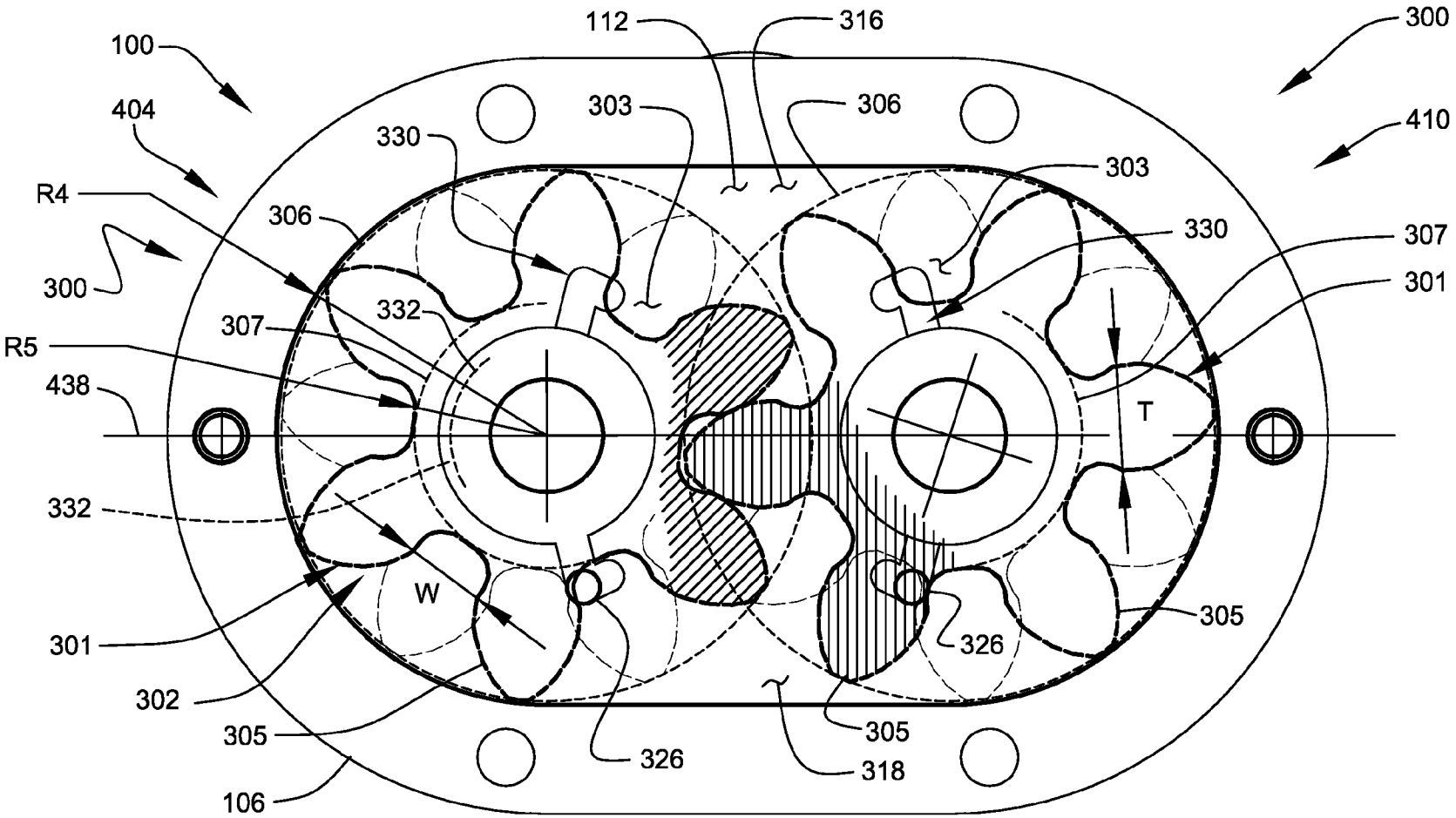
FIG. 25 shows a schematic sectional diagram, illustrating alternate preferred end plate geometry in relation to the preferred helical gear geometry of the pulse-cancelling positive pressure gear pump of FIG. 23.

The following teachings will describe Applicant's actively-controlled shunting of fluid pressures between the discharge and suction regions of the pump using pulse-canceling circuit 330. In that regard, FIG. 24A shows a perspective view, illustrating the inner face of an alternate end plate 404 incorporating pulse-canceling circuit 330, according to another preferred embodiment of the present invention. FIG. 24B shows a perspective view, illustrating the outer side of the alternate end plate 404 of FIG. 24A. FIG. 24C shows an elevational view, illustrating the inner side of the alternate end plate 404 and FIG. 24D shows a portion of the inner side of the alternate end plate, magnified for clarity. FIG. 25 shows a diagrammatic sectional view of the preferred alternate end plate 404 (containing pulse-canceling circuit 330) integrated within the previously-presented pulse-cancelling positive-pressure gear pump 300.

Pulse-canceling circuit 330 is preferably configured to return the viscous molten fluids from discharge-pressure region 316 to suction-pressure region 318. In one preferred embodiment of the system, each pulse-cancelling positive-pressure gear pump 300 comprises four separate pulse-canceling circuits 330 preferably integrated within the outer alternate end plates 404. In this preferred arrangement, two of the four pulse-canceling circuits 330 are integrated within each opposing alternate end plate 404 of pulse-cancelling positive-pressure gear pump 300, as shown in FIG. 24A.

Referring to FIG. 24A through FIG. 24D, pulse-canceling circuit 330 preferably comprises return inlet 324 and return outlet 326, as shown. Preferably, return inlet 324 is located in fluid communication with discharge-pressure region 316 and return outlet 326 is preferably arranged to be in fluid communication with suction-pressure region 318. Inlet 324 and return outlet 326 are preferably coupled by at least one fluid pathway 328, as shown.

In preferred embodiments of the system, at least one portion of fluid pathway 328 passes through gear-journal bore 142. In pulse-cancelling positive-pressure gear pump 300, the entire fluid pathway 328 passes through gear-journal bore 142. Thus, each pulse-canceling circuit 330 is preferably associated with one gear-journal bore 142 and one bearing surface of alternate end plates 404. More specifically, fluid pathway 328 preferably extends between a respective shaft journal 332 of phase-balanced gear 301 (see FIG. 22 and FIG. 25) and bushing 144 disposed within a respective gear-journal bore 142 (see also FIG. 16).

In the depicted pulse-cancelling positive-pressure gear pump 300, passage of viscous molten fluids through fluid pathway 328 preferably provides friction-reducing lubrication of the bushings 144 located along the return-flow path. Thus, each fluid pathway 328 of each pulse-canceling circuit 330 preferably establishes a lubrication pathway 408 within the pump to divert a portion of the viscous molten fluid to assist hydrodynamic lubrication of the bearing surfaces.

In the depicted pulse-cancelling positive-pressure gear pump 300, shaft journal 332 comprises a preferred diameter of about 1.607 inches (2.71 cm) and bushing 144 comprises a bore diameter of about 1.618 inches (4.109 cm). Additional flow clearance may preferably be provided by lubrication grooves recessed within the bore of bushing 144. It is also noted that the preferred helical design of phase-balanced gears 301 produces a transverse thrust that relocates shaft slightly off a centerline position to one side of the bore, thus altering the shaft-to-bore clearance available for fluid passage. In practice, it is surmised that the reduced cross-sectional area of the bearing passage has the effect of suppressing the effective rate of flow through the active pulse-canceling circuits 330.

Pulse-canceling circuit 330 is preferably structured and arranged to move the viscous molten fluids through fluid pathway 328/lubrication pathway 408 by the pressure differential generated during pump operation. Pulse-cancelling positive-pressure gear pump 300 is preferably designed to enable substantially one-way movement of the viscous molten fluids through lubrication pathway 408. In preferred operation, essentially all viscous molten fluids used to lubricate the bearing surface move through lubrication pathway 408 from the high-pressure region to the low-pressure region of the pump.

In specific reference to FIG. 24A through FIG. 24D, each alternate end plate 404 preferably comprises an inner chamber face 406 that, when mounted in an operable position to pump housing 106 (as similarly depicted FIG. 2), is preferably located adjacent to and in approximately parallel orientation with respective terminating gear faces 311. In such a mounted arrangement, inner chamber face 406 is preferably in communication with internal chamber 112.

Preferably, return inlet 324 comprises at least one inlet channel 414 preferably comprising a shallow L-shaped recess formed within inner chamber face 406, as shown. In pulse-cancelling positive-pressure gear pump 300, inlet channel 414 of return inlet 324 comprises a preferred width M of 0.3 inch (0.762 cm) and a semi-circular cross-sectional area of about 0.035 square inches (0.0889 cm). As best illustrated in the elevational view of FIG. 24D, inlet channel 414 preferably radiates outwardly from a respective gear-journal bore 142 and is preferably configured to assist channeling of the viscous molten fluids from discharge-pressure region 316 inwardly toward bearing surfaces associated with a respective gear-journal bore 142. Once the viscous molten fluids have moved outwardly through the gear-journal bore 142, the viscous molten fluids preferably pass within an outer hollow cavity 416 located within alternate end plate 404, which is preferably sealed beneath a respective end-unit modifier 134. Preferably, the viscous molten fluids are conducted from outer hollow cavity 416 to suction-pressure region 318 along a return path of fluid pathway 328 that is preferably external of the gear-journal bore 142 and bushing 144. The return path of fluid pathway 328 preferably comprises a circular bore extending through alternate end plate 404 in an orientation generally parallel to gear-journal bore 142, as shown. The return path of fluid pathway 328 is preferably in fluid communication with both hollow cavity 416 and return outlet 326, as shown.

Return outlet 326 is preferably located within inner chamber face 406 of a respective alternate end plate 404, as shown. Preferably, the viscous molten fluids are discharged from fluid pathway 328 to suction-pressure region 318 through return outlet 326. It is noted that return outlet 326 is also preferably supplied with a recessed channel 418 located symmetrically opposite inlet channel 414. Recessed channel 418 is preferably configured to direct the viscous molten fluids toward the bearing surfaces when the pump is reversed or orientation of the endplate is rotated. It is noted that in a modular endplate design, a corresponding return outlet 326 is preferably provided at inlet channel 414. This return outlet is preferably plugged, except in circumstances where the orientation of the end plate is rotated or the predominate direction of pump operation is to be reversed.

In specific reference to alternate end plate 404 of FIG. 24D, gear-journal bore 142 comprises a preferred inner radius R1 of about one inch (2.54 cm). Inlet channel 414 of return inlet 324 preferably comprises a first leg 409 radiating outwardly from gear-journal bore 142 at an angle Q2 of about 104 degrees relative to transverse line of symmetry 438, as shown. Preferably, each inlet channel 414 extends outwardly from gear-journal bore 142 so that at least one portion of inlet channel 414 falls between the inner root circle 307 and the outer addendum circle 306 of the adjacent terminating gear face 311. More preferably, inlet channel 414 extends beyond gear-journal bore 142 a minimum distance N of about 0.6 inch (1.524 cm). This preferred arrangement positions an area of inlet channel 414, at least about equal to a circle having a diameter of about 0.3 inch (0.762 cm), beyond the inner root circle 307 of the adjacent terminating gear face 311 (and in potential fluid interaction with the discharge-pressure region 316). More preferably, inlet channel 414 turns laterally, as shown, to form second leg 413. Second leg 413 preferably extends to a semi-circular termination 411 having a radius R2 of about 0.15 inch (0.381 cm) and a center point separated from first leg 409 by an angle Q2 of approximately 10 degrees. Preferably, the lower edge of the semi-circular termination 411 (relative to the view of FIG. 24D) is situated to approximately coincide with inner root circle 307, as shown.

Recessed channel 418 is preferably located symmetrically opposite inlet channel 414, relative to transverse line of symmetry 438, and is symmetrically identical to inlet channel 414 except as noted herein. Preferably, recessed channel 418 includes return outlet 326, preferably returning the viscous molten fluids from outer hollow cavity 416 to discharge from fluid pathway 328 to suction-pressure region 318. Return outlet 326 preferably comprises a radius R3 of about 0.15 inch (0.381 cm). Upon reading this specification, those with ordinary skill in the art will now appreciate that, under appropriate circumstances, considering such issues as cost, intended use, etc., other pulse-canceling circuit arrangements such as, for example, alternate inlet and/or outlet angular positions, alternate numbers of ports, alternate port-size arrangements, etc., may suffice.

Figure 26:
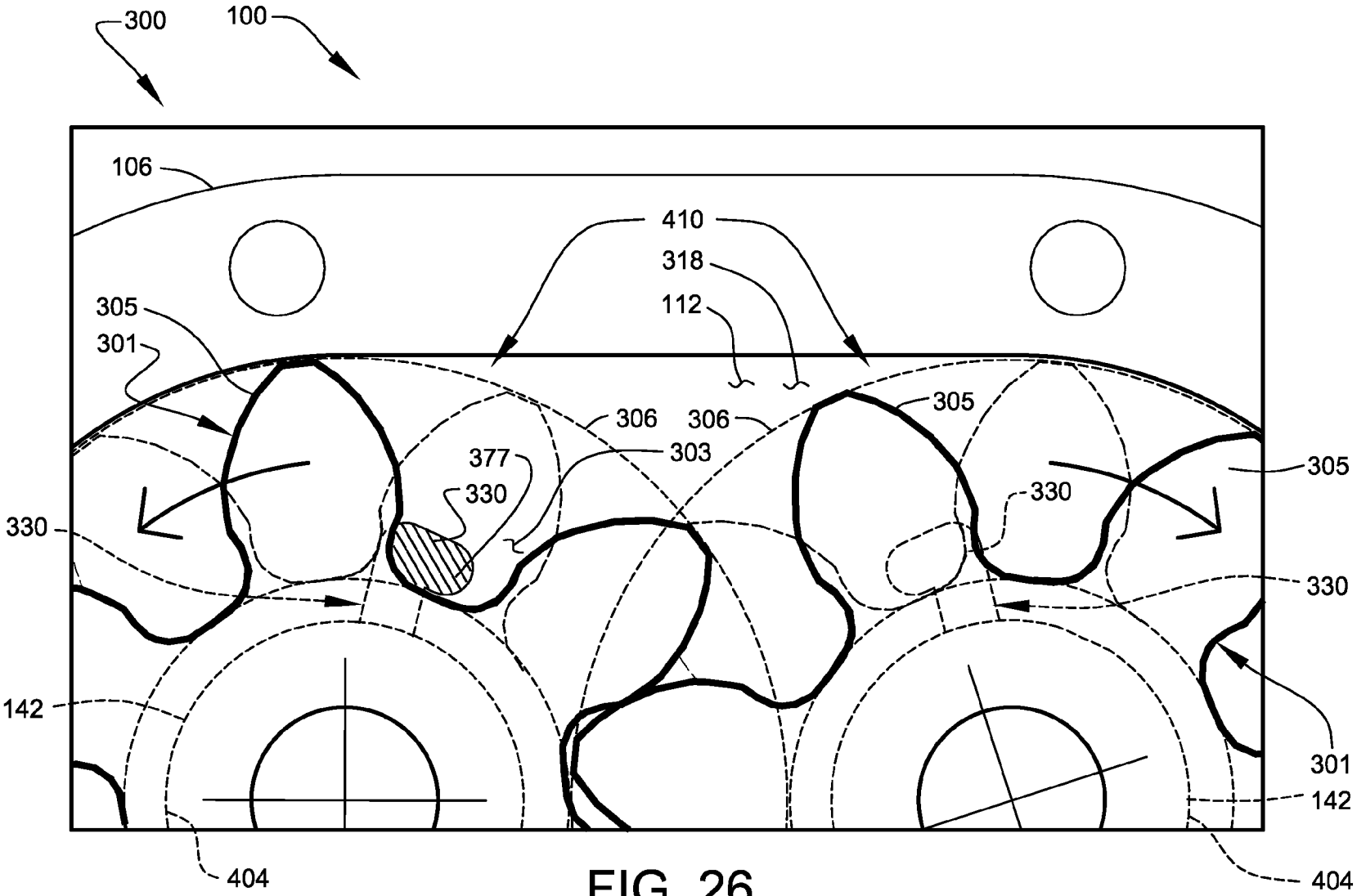
FIG. 26 shows a schematic sectional diagram, illustrating, in greater detail, the alternate preferred end plate geometry of FIG. 25.

FIG. 25 shows a schematic sectional diagram, illustrating alternate preferred end plate geometry 404 in relation to the preferred helical gear geometry of pulse-cancelling positive-pressure gear pump 300. FIG. 26 shows a diagrammatic sectional view, magnified for clarity, of the preferred pulse-cancelling positive-pressure gear pump 300 of FIG. 25 incorporating pulse-canceling circuit 330.

When operably mounted within internal chamber 112 of the pump, both return inlet 324 and return outlet 326 are preferably located adjacent to a terminating gear face 311. More specifically, a portion of both return inlet 324 and return outlet 326 are preferably located within a region of inner chamber face 406 located within about the outer addendum circle 306 of the adjacent terminating gear face 311, as diagrammatically shown. In the depicted pulse-cancelling positive-pressure gear pump 300, the clearance between terminating gear face 311 and inner chamber face 406 is about 0.015 inch (0.381 cm).

During gear rotation, both return inlet 324 and return outlet 326 are alternately covered and uncovered by the sequential passage of solid helical teeth 305 and open root regions 377 of the teeth passing adjacent the inlet and outlet openings (i.e., by rotation of the gear teeth about a respective rotation axis 314 of a respective phase-balanced gear 301). The above-described arrangements of pulse-canceling circuit 330 are thus preferably arranged to form a flow modulator 410, which is preferably configured to modulate the flow volume of the viscous molten fluids through pulse-canceling circuit 330.

Flow modulator 410 is preferably actively controlled by the rotation of phase-balanced gear 301. More specifically, the operational timing and coordination of flow modulator 410 is preferably controlled by the physical geometry of helical teeth 305. Observation of pulse-cancelling positive-pressure gear pump 300 during operation suggests that the primary modulation of flow through pulse-canceling circuit 330 is controlled by the covering and uncovering return inlets 324. Thus, the active control of flow modulator 410 is coordinated with the operational timing of the pump preferably due to the direct action of helical teeth 305 in blocking and unblocking return inlet 324 located at the pressure side of the pump (at least embodying herein at least one active controller structured and arranged to actively control the operation of such at least one flow modulator and wherein such at least one active controller comprises at least one coordinator structured and arranged to coordinate the operational timing of such at least one flow modulator with cyclic pressure fluctuations exhibited by such at least one modular-component pump during operation). Applicant believes this action momentarily reduces local vacuum levels, within the inlet side of the pump, by introducing fluid at increase pressure coinciding with the development of peak partial vacuums created as the gear teeth unmesh along the helical profile. This preferred arrangement allows the pump to operate at speeds that would normally induce cavitation.

In pulse-cancelling positive-pressure gear pump 300, the solid helical teeth 305 of phase-balanced gear 301 comprise a preferred thickness T of about 0.8 inch (2.032 cm) and preferably comprise an open width W of about 0.7 inch (1.778 cm) at root region 377. Both thickness T and width W are associated with the regions of helical teeth 305 that interact with return inlets 324 to establish the preferred timing of flow modulator 410.

Figure 27:
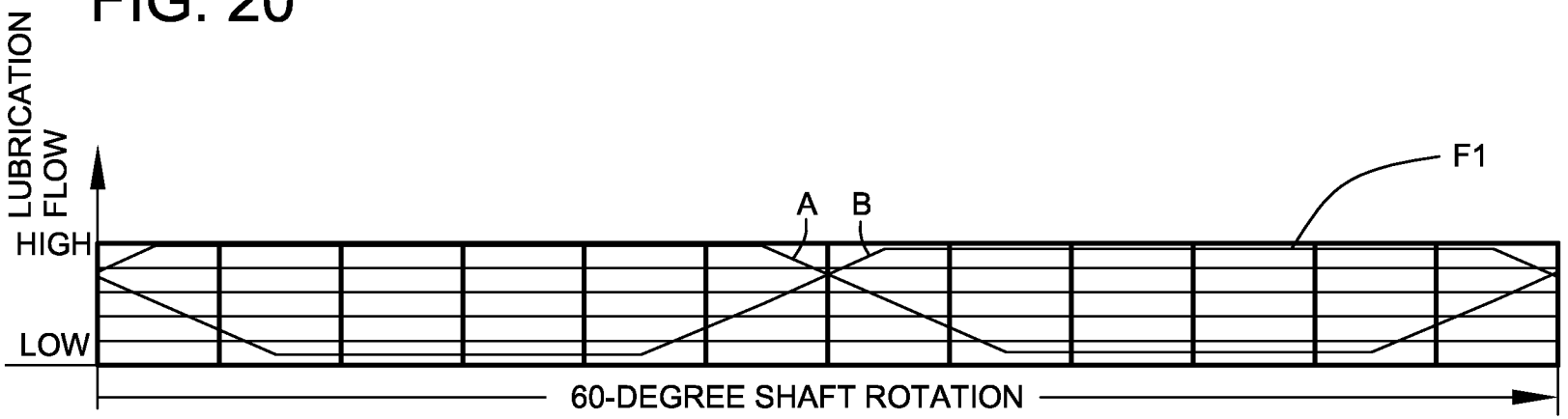
FIG. 27 shows a diagram plotting performance data of a pulse-canceling circuit during a 60-degree rotation of the pulse-cancelling positive-pressure gear pump.

FIG. 27 shows a graphical plot generally illustrating the open area of the return inlets 324 of two fluid pathways 328 during a 60-degree rotation of pulse-cancelling positive-pressure gear pump 300. In practice, it is surmised that the reduced cross-sectional area of the bearing passage has the preferred effect of suppressing the effective rate of flow and pressure through the active pulse-canceling circuits 330. It is further noted that the differential pressure across active pulse-canceling circuits 330 is not constant, thus creating varying flow-rate characteristic through the circuit; however, the graphical plot F1 may be used to approximate lubrication flow and associated pressure modulation through return inlets of one alternate end plate 404 during pump operation.

The plot lines A and B of FIG. 27 are associated return inlets 324 of one alternate end plate 404 and illustrates that each return inlet 324 of one alternate end plate 404 is open to the discharge-pressure region 316 at least once during each 60-degree rotation of the pump. Furthermore, the plot shows that the two return inlets 324 are open in opposing phase (with flow modulator 410 providing short periods of simultaneous overlapping flow through both circuits). It is suggested that this action further assists in suppressing pulsation in the output flow by repeated momentarily reductions of both local peak pressures and local vacuum levels within internal chamber 112, in a manner timed to the inherent pulse generation pattern of the pump.

Such preferred modulation of the flow of the viscous molten fluids through pulse-canceling circuit(s) 330 preferably assist in reducing peak amplitudes of cyclic fluctuations in output pressure exhibited by pulse-cancelling positive-pressure gear pump 300. The system was further demonstrated to attenuate the counteracting vacuum pulse on the inlet side (which offsets the pressure pulse at the discharge side of the pump). This appears to significantly reduce the tendency of the pump to exhibit cavitation at higher operational speeds.

A pump that is close to its critical point may begin to cavitate even when pulse-induced fluctuations in suction-side vacuum levels are relatively small. Stabilization of the flow was found to have a two-fold benefit of eliminating the pulse and its affect on both the outlet pressure and the inlet vacuum. This stabilized flow measurably raises the cavitation point (and maximum flow) of the pump.

Figure 28:
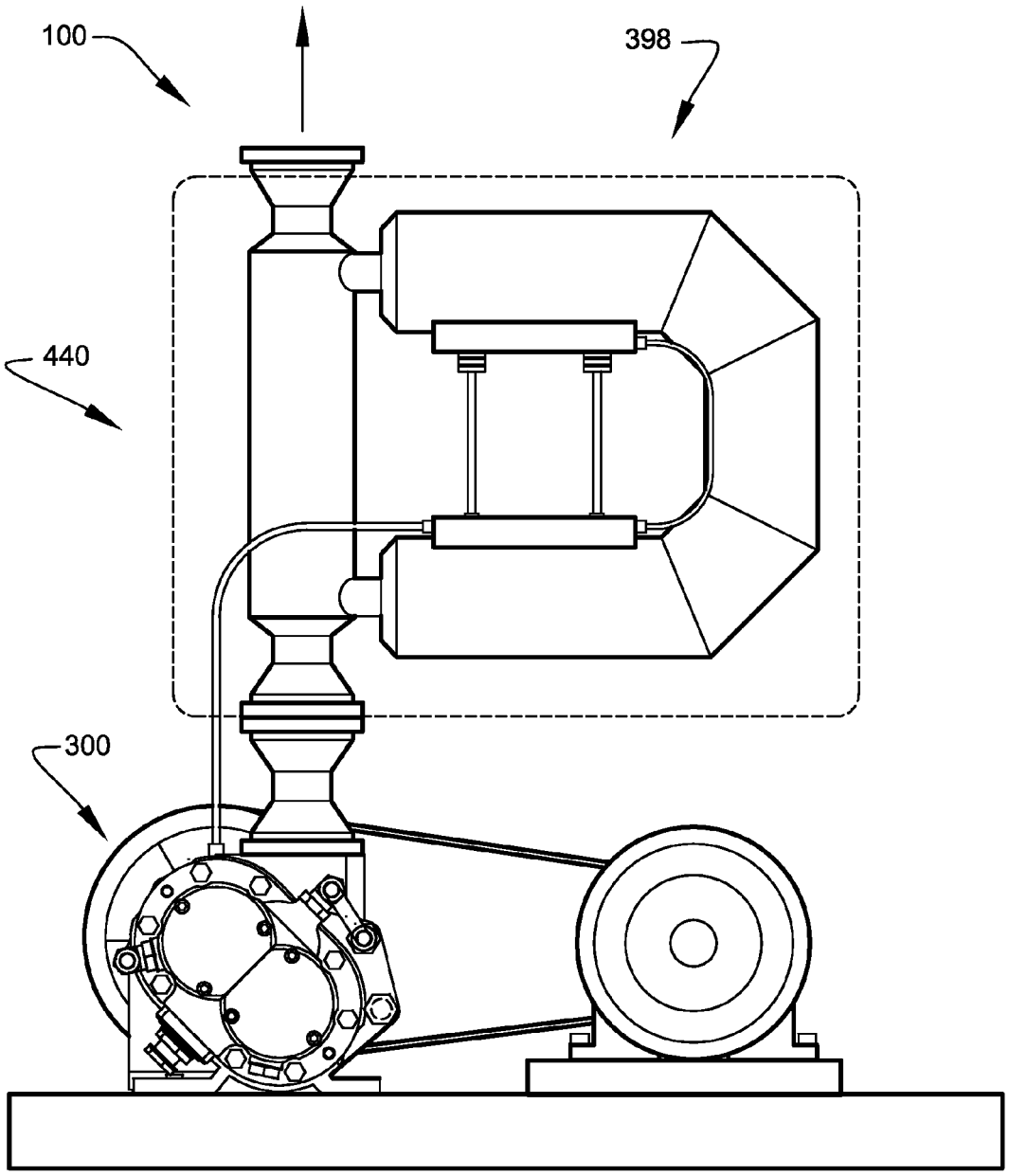
FIG. 28 shows a side view diagrammatically illustrating a metering device operably arranged to meter the output of the pulse-cancelling positive-pressure gear pump, according to another preferred embodiment of the present invention.

FIG. 28 shows a side view illustrating metering device 398 operably arranged to meter the output of pulse-cancelling positive-pressure gear pump 300, according to another preferred embodiment of the present invention. The depicted pulse-cancelling positive-pressure gear pump 300 is presented as one preferred example embodiment representative of preferred pump embodiments configurable within asphalt pumping system 100. Although a modular-component pump is shown, it should be understood that Applicant's pulse-attenuation arrangements, as described herein, are preferably adaptable to many other positive-displacement external gear pump designs.

Pulse-cancelling positive-pressure gear pump 300 allows metering devices 398 to operate with a greater degree of metering accuracy. In a preferred arrangement of the present system, metering devices 398 comprises a mass flow meter 440, as shown. Mass flow meters, also known as inertial flow meters or coriolis flow meters, are devices that measure mass flow rate of a fluid traveling through a tube. The operating principal of the device is the Coriolis effect or conservation of angular momentum due to the Coriolis acceleration of a fluid flow. Flow through mass flow meter 440 is preferably divided into two streams by a splitter near the meter's inlet and is recombined at the exit. A vibratory force is applied to the tubes, which is preferably monitored by a set of sensors. When there is no flow of the viscous molten fluids in the tubes, the inducted vibration results in identical displacements at the sensing points. When flow is present, Coriolis forces act to produce a secondary twisting vibration, resulting in a small phase difference in the relative motions. This is preferably detected at sensing points within the assembly. Pulsations produced by conventional positive displacement pumps typically reduce metering accuracy by introducing "noise" that must be filtered from the sensor output. Metering accuracy is particularly problematic when the pump pulsating frequency is near or at a rate that coincides with the meter functioning frequencies.

A conventional solution to this problem is to slow the operation of the pump, which is a highly negative option for most pump operators. Slowing the pump generally results in a slowing of the entire production process. Mounting the meter far downstream of the pump may also provide a small degree of flow stabilization, but typically does not reduce the pulsation below levels required for acceptable metering accuracy at optimal pump speeds. As a result, production output would again be greatly reduced if such arrangements were utilized with conventional pump designs.

The use of Applicant's preferred pulse-cancelling positive-pressure gear pump 300 allows the use of mass flow meter 440 with a high degree of metering accuracy.

Although applicant has described applicant's preferred embodiments of this invention using metric standardized units, such measurements have been provided only for the convenience of the reader and should not be read as controlling or limiting. Instead, the reader should interpret any measurements provided in English standardized units as controlling. Any measurements provided in metric standardized units were merely derived through strict mechanical coding, with all converted values rounded to two decimal places.

Further, although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system, relating to providing user control of local geometries in pumping viscous molten fluids with a pump, through pump modularity, wherein the pump modularity permits placement variation among ports, passages, and driveshaft, comprising:

a) a modular-component pump structured and arranged to pump the viscous molten fluids;

b) wherein said modular-component pump comprises i) a central pump housing having a first open end, a second open end, and an internal chamber extending between said first open end and said second open end, ii) an inlet to inlet the viscous molten fluids to said internal chamber and an outlet to outlet the viscous molten fluids from said internal chamber, iii) operating within said internal chamber, a shaft-driven fluid displacer structured and arranged to displace the viscous molten fluid from said inlet to said outlet, iv) a first single-geometry end unit structured and arranged to interchangeably engage a selected one of either of said first open end or said second open end, v) a second single-geometry end unit, having a geometric configuration common with said first single-geometry end unit, said second single-geometry end unit structured and arranged to interchangeably engage a remaining one of either of said first open end or said second open end, and vi) a set of interchangeable end-unit modifiers each one structured and arranged to interchangeably modify the function of said first single-geometry end unit and said second single-geometry end unit;

c) wherein said shaft-driven fluid displacer comprises a driveshaft structured and arranged to operably couple said shaft-driven fluid displacer with a source of rotational power external of said central pump housing;

d) wherein said set of interchangeable end-unit modifiers comprises i) a shaft-type modifier structured and arrange to modify either of said first single-geometry end unit and said second single-geometry end unit to comprise a drive-shaft passage enabling rotatable passage of said drive-shaft, and ii) cover-type modifiers, each one of the cover-type modifiers is structured and arrange to cover an external opening, of either of said first single-geometry end unit and said second single-geometry end unit, in fluid communication with an internal chamber; and e) wherein said modular-component pump assists to provide user control of local geometries in pumping the viscous molten fluids with said modular-component pump;

f) wherein said shaft-driven fluid displacer is structured and arranged to generate, within said internal chamber, a suction-pressure region in fluid communication with said inlet and a discharge-pressure region in fluid communication with said outlet;

g) wherein each one of said first single-geometry end unit and said second single-geometry end unit further comprise a first fluid return passage structured and arranged to return the viscous molten fluids from said discharge-pressure region to said suction-pressure region;

h) wherein each said first fluid return passage comprises a first return inlet, a first return outlet, and a control valve structured and arranged to control passage of the viscous molten fluid between said first return inlet and said first return outlet;

i) wherein each said control valve comprises a normally closed position blocking flow of the viscous molten fluids through said first fluid return passage and an open position enabling one-way flow of the viscous molten fluids between said first return inlet and said first return outlet;

j) wherein each said control valve is configured to transition from said normally closed position to said open position in response to an elevated fluid pressure in said discharge-pressure region above a selected pressure threshold; and k) wherein when each said control valve is in said open position, return circulation of the viscous molten fluids through said first fluid return passage is enabled between said discharge-pressure region and said suction-pressure region.

2. The system according to claim 1 wherein each said control valve comprises a pressure-threshold selector structured and arranged to enable user selection of the selected pressure threshold.

3. The system according to claim 2 wherein:

a) said modular component pump is a positive-displacement external gear pump;

b) said shaft-driven fluid displacer comprises i) a first pumping gear disposed rotatably within said internal chamber, and ii) meshing with said first pumping gear, a second pumping gear disposed rotatably within said internal chamber;

c) said first pumping gear comprises i) said drive shaft, and ii) a first rotational axis oriented coaxially with said drive shaft;

d) said second pumping gear comprises a second rotational axis spaced apart from and generally parallel to said first rotational axis;

e) each said first single-geometry end unit and said second single-geometry end unit comprises gear-journal bores structured and arranged to rotatably journal therein said first pumping gear and said second pumping gear;

f) each one of said gear-journal bores is structured and arranged to interchangeably journal therein either one of said first pumping gear and said second pumping gear; and g) each one of said gear-journal bores extends through one of said single-geometry end units to enable passage of said driveshaft through one of said single-geometry end units.

4. The system according to claim 3 wherein:

a) when disposed within said internal chamber, said first pumping gear and said second pumping gear are structured and arranged to divide said internal chamber into a first chamber portion and a second chamber portion;

b) said first chamber portion is configured to comprise said suction-pressure region when said driveshaft is driven in a forward rotation;

c) said second chamber portion is configured to comprise said discharge-pressure region when said driveshaft is driven in the forward rotation;

d) said first chamber portion is configured to comprise said discharge-pressure region when said at least one drive-shaft is driven in a reversed rotation;

e) said second chamber portion is configured to comprise said suction-pressure region when said driveshaft is driven in the reversed rotation; and f) each said first fluid return passage is in fluid communication with both said first chamber portion and said second chamber portion.

5. The system according to claim 4 wherein said first single-geometry end unit and said second single-geometry end unit each comprise:

a) a first plane of symmetry dividing said single-geometry end unit into a first half portion and a second half portion;

b) wherein said first half portion and said second half portion comprise symmetrically opposite functional geometries;

c) wherein, said first plane of symmetry is located equidistant from both said first rotational axis and said second rotational axis; and d) wherein, when said first single-geometry end unit and said second single-geometry end unit are each mated to said central pump housing, said first plane of symmetry is oriented about perpendicular to an axis-containing plane containing both said first rotational axis and said second rotational axis.

6. The system according to claim 5 wherein:

a) each said first half portion and each said second half portion each comprise a gear-journal bore of said gear-journal bores; and b) each one of said gear-journal bores includes a bearing.

7. The system according to claim 6 wherein each said bearing is a plain bearing.

8. The system according to claim 6 wherein each said bearing is a rolling-element bearing.

9. The system according to claim 5 wherein:

a) each said first fluid return passage is disposed between said gear-journal bores and in one position intersects said first plane of symmetry; and b) said first single-geometry end unit and said second single-geometry end unit are structured and arranged to be symmetrically mountable to said central housing to selectably locate each said first return inlet and each said first return outlet in fluid communication with either of said first chamber portion and said second chamber portion.

10. The system according to claim 9 wherein said central housing further comprises:

a) a mount structured and arranged to assist mounting of said modular-component pump to a mountable support external of said modular-component pump;

b) wherein said mount comprises a mounting contact surface, comprising a contact-surface plane, structured and arrange to contact the mountable support;

c) wherein said central housing is further structured and arranged to orient said axis-containing plane, containing both said first rotational axis and said second rotational axis, in a non-parallel orientation relative to said contact-surface plane; and d) wherein said non-parallel orientation geometrically positions one of said first rotational axis and said second rotational axis further from said mounting-surface plane than the other one of said first rotational axis and said second rotational axis when said first pumping gear and said second pumping gear are journaled rotatably within said first single-geometry end unit and said second single-geometry end unit.

11. The system according to claim 10 wherein said central housing is further structured and arranged to orient said axis-containing plane, containing both said first rotational axis and said second rotational axis, at about a 45-degree angle relative to said contact-surface plane.

12. The system according to claim 10 wherein said shaft-type modifier comprises:

a) detachably mountable to either of said first half portion and said second half portion, an apertured cap plate having a shaft-passing aperture structured and arranged to enable outward passage of said driveshaft therethrough;

b) wherein said shaft-passing aperture of said apertured cap plate is structured and arranged to coaxially align with a respective one of said gear-journal bores when said apertured cap plate is detachably mounted to either of said first half portion and said second half portion.

13. The system according to claim 12 wherein each one of said cover-type modifiers comprises:

a) detachably mountable to either of said first half portion and said second half portion, a non-apertured cap plate structured and arranged to cover a respective one of said gear-journal bores when said apertured cap plate is detachably mounted to either of said first half portion and said second half portion.

14. The system according to claim 10 wherein one of said first single-geometry end unit and said second single-geometry end unit comprises a first outer fluid jacket structured and arranged to assist circulation of a thermal-transfer fluid usable to control the temperature of the viscous molten fluids within said first single-geometry end unit and said second single-geometry end unit.

15. The system according to claim 10 wherein said central pump housing comprises a second outer fluid jacket structured and arranged to assist circulation of the thermal-transfer fluid usable to control the temperature of the viscous molten fluids within said central pump housing.

16. The system according to claim 13 wherein:

a) said first single-geometry end unit is operably-mounted to said central pump housing in an orientation locating said first return inlet, of said first single-geometry end unit, in fluid communication with said second chamber portion;

b) said second single-geometry end unit is operably-mounted to said central pump housing in an orientation locating said first return inlet, of said second single-geometry end unit, in fluid communication with said first chamber portion;

c) return circulation of the viscous molten fluids is enabled between said second chamber portion and said first chamber portion through said first fluid return passage of said first single-geometry end unit when a fluid pressure above the selected pressure threshold is developed within said discharge-pressure region of said second chamber portion by a forward rotation of said input shaft; and d) return circulation of the viscous molten fluids is enabled between said first chamber portion and said second chamber portion through said first fluid return passage of said second single-geometry end unit when a fluid pressure above the selected pressure threshold is developed within said discharge-pressure region of said first chamber portion by a reverse rotation of said input shaft.

17. The system according to claim 16 wherein said pressure-threshold selector of said control valve of said first single-geometry end unit is adjustable independently of said pressure-threshold selector of said control valve of said second single-geometry end unit.

18. The system according to claim 13 wherein:

a) said first single-geometry end unit is operably-mounted in an orientation locating said first return inlet, of said first single-geometry end unit, in fluid communication with said second chamber portion;

b) said second single-geometry end unit is operably-mounted in an orientation locating said first return inlet, of said second single-geometry end unit, in fluid communication with said second chamber portion; and c) high-volume return circulation of the viscous molten fluids is enabled between said second chamber portion and said first chamber portion by a return flow through both said fluid return passages of said first single-geometry end unit and said second single-geometry end unit when a fluid pressure above the selected pressure threshold is developed within said discharge-pressure region of said second chamber portion.

19. The system according to claim 6 further comprising:

a) a second fluid return passage structured and arranged to return the viscous molten fluids from said discharge-pressure region to said suction-pressure region;

b) wherein said second fluid return passage comprises i) in fluid communication with said discharge-pressure region, a second return inlet, ii) in fluid communication with said suction-pressure region, a second return outlet, and iii) in fluid communication with said second return inlet and said second return outlet, a fluid pathway passing through one of said gear-journal bores.

20. The system according to claim 19 wherein:

a) said fluid pathway extends between a shaft journal of said shaft-driven fluid displacer and a plain bearing of the one of said gear-journal bores; and b) passage of the viscous molten fluids through said fluid pathway assists friction-reducing lubrication of said plain bearing.

21. The system according to claim 20 wherein said second fluid return passage is part of a flow modulator structured and arranged to modulate the flow volume of the viscous molten fluids through said fluid pathway.

22. The system according to claim 21 wherein each one of said first pumping gear and said second pumping gear comprises:

a) a set of gear teeth defining an outer addendum circle and an inner root circle; and b) an opposing pair of terminating gear faces defining a gear-face width;

c) wherein each terminating gear face of said opposing pair of terminating gear faces is oriented transversely to a respective rotation axis of said first pumping gear and said second pumping gear.

23. The system according to claim 22 wherein each one of said first single-geometry end unit and said second single-geometry end unit comprises:

a) an inner chamber face structured and arranged to be in communication with said internal chamber;

b) wherein said inner chamber face is located adjacent to and in parallel orientation with said terminating gear faces.

24. The system according to claim 23 wherein said second return inlet comprises:

a) located within said inner chamber face, an inlet channel structured and arranged to assist channeling of the viscous molten fluids from said discharge-pressure region to said gear-journal bore of said gear-journal bores;

b) wherein said inlet channel is located within a region of said inner chamber face adjacent to one of said terminating gear faces; and c) wherein a portion of said inlet channel is located within a region of said inner chamber face located within about the outer addendum circle of said terminating gear face.

25. The system according to claim 24 wherein said second return outlet comprises:

a) located within said inner chamber face, an outlet port structured and arranged to outlet the viscous molten fluids from said fluid pathway to said suction-pressure region;

b) wherein said outlet port is located within a region of said inner chamber face adjacent to one of said terminating gear faces.

26. The system according to claim 25 further comprising metering device structured and arranged to meter outputs of the viscous molten fluids.

27. The system according to claim 26 wherein said metering device comprises a coriolis-type flow meter.

28. A pumping system relating to pumping viscous molten fluids comprising:

a) a modular-component pump structured and arranged to pump the viscous molten fluids;

b) wherein said modular-component pump comprises i) a pump housing having a right-hand open end, a left-hand open end, and an internal chamber extending between said right-hand open end and said left-hand open end, ii) an inlet to inlet the viscous molten fluids to within said internal chamber and an outlet to outlet the viscous molten fluids from said internal chamber, iii) operating within said internal chamber, a shaft-driven fluid displacer structured and arranged to displace the viscous molten fluid from said inlet to said outlet, and iv) mounted to each of said right-hand open end and said left-hand open end, a modifiable single-geometry end unit structured and arranged to modifiably cover said internal chamber;

v) wherein said shaft-driven fluid displacer comprises a driveshaft structured and arranged to operably couple said shaft-driven fluid displacer with a source of rotational power external of said pump housing;

c) wherein said modular-component pump is configurable in four configurations using the modifiable single-geometry end units;

d) wherein said modifiable single-geometry end units are selectably mountable to said pump housing in said four configurations;

e) wherein two left-hand driveshaft configurations, enabling left-hand outward passage of said driveshaft from said pump housing, are field configurable; and f) wherein two right-hand driveshaft configurations, enabling right-hand outward passage of said driveshaft from said pump housing, are field configurable g) wherein each said modifiable single-geometry end unit comprises a pressure-relief valve structured and arranged to return circulation of the viscous molten fluids between said discharge-pressure region and said suction-pressure region of said internal chamber in response to an elevated fluid pressure in said discharge-pressure region above a selected pressure threshold; and h) wherein said modular-component pump is field configurable in three pressure-relieving configurations using two modifiable single-geometry end units.

29. A pumping system relating to pumping viscous molten fluids comprising:

a) a modular-component pump structured and arranged to pump the viscous molten fluids;

b) wherein said modular-component pump comprises i) a pump housing having a first open end, a second open end, and an internal chamber extending therebetween, ii) an inlet to inlet the viscous molten fluids to within said internal chamber and an outlet to outlet the viscous molten fluids therefrom, iii) operating within said internal chamber, a shaft-driven fluid displacer structured and arranged to displace the viscous molten fluid from said inlet to said outlet, and iv) a modular housing plate mountable to either of said first open end and said second open end;

c) wherein said shaft-driven fluid displacer comprises a driveshaft structured and arranged to operably couple said shaft-driven fluid displacer with a source of rotational power external of said central pump housing;

d) wherein said modular housing plate is configurable as either a pump end plate, to cap a selected one of either said first open end or said second open end, or a pump shaft plate structured and arranged to accommodate passage of said driveshaft through said modular housing plate from a selected one of either of said first open end or said second open end;

e) wherein when disposed within said internal chamber, said shaft-driven fluid displacer divides said internal chamber into a high pressure region and a low pressure region;

f) wherein said modular housing plate comprises a pressure-relief valve structured and arranged to return circulation of the viscous molten fluids between said high pressure region and said low pressure region of said internal chamber in response to an elevated fluid pressure in said high pressure region above a selected pressure threshold; and g) wherein said modular-component pump is field configurable in three pressure-relieving configurations using two modular housing plates.

30. A pump system, comprising:

a) a gear pump the gear pump includes an internal pumping chamber;

b) disposed within said internal pumping chamber, a set of intermeshing helical gears;

c) wherein each helical gear of said set of intermeshing helical gears comprises i) a set of gear teeth defining an outer addendum circle and an inner root circle; and ii) an opposing pair of terminating gear faces defining a gear-face width;

d) wherein each terminating gear face of said opposing pair of terminating gear faces is oriented transversely to a respective rotation axis of said set of intermeshing helical gears;

e) wherein said set of gear teeth comprise a helix angle, relative to said respective rotation axis, providing exactly a one-half tooth pitch rotation from one terminating gear face to the opposing terminating gear face, said set of gear teeth are structured and arranged to reduce fluid pressure pulses relative to a set of gear teeth with straight teeth by pulse pressure cancellation;

f) wherein when disposed within said internal chamber, said set of intermeshing helical gears are structured and arranged to divide said internal chamber into a discharge-pressure region and a suction-pressure region;

g) wherein said gear pump includes a fluid return passage structured and arranged to return the viscous molten fluids from said discharge-pressure region to said suction-pressure region;

h) wherein said fluid return passage includes:

i) in fluid communication with said discharge-pressure region, a return inlet, ii) in fluid communication said suction-pressure region, a return outlet, and iii) in fluid communication with said return inlet and said return outlet, a fluid pathway extending therebetween;

i) wherein said fluid return passage forms a flow modulator to modulate the flow volume of the viscous molten fluids through said second fluid pathway;

j) said set of intermeshing helical gears are structured and arranged to control operation of said flow modulator and to coordinate the operational timing of said flow modulator with cyclic pressure fluctuation exhibited by said gear pump during operation.

31. The system according to claim 30 further comprising metering device structured and arranged to meter outputs of the viscous molten fluids.

* * * * *